United States Patent [19]

Haneda et al.

[11] Patent Number: 5,065,195

[45] Date of Patent: Nov. 12, 1991

[54] COLOR IMAGE FORMING APPARATUS HAVING A FREELY INSTALLABLE AND DETACHABLE PROCESS CARTRIDGE

[75] Inventors: Satoshi Haneda; Masakazu Fukuchi; Shunji Matsuo; Shizuo Morita, all of Hachioji, Japan

[73] Assignee: Konica Corporation, Tokyo, Japan

[21] Appl. No.: 545,464

[22] Filed: Jun. 28, 1990

[30] Foreign Application Priority Data

| | | | |
|---|---|---|---|
| Jul. 5, 1989 | [JP] | Japan | 1-175248 |
| Jul. 13, 1989 | [JP] | Japan | 1-180783 |
| Aug. 9, 1989 | [JP] | Japan | 1-207243 |
| Aug. 22, 1989 | [JP] | Japan | 1-217080 |

[51] Int. Cl.[5] ..... G03G 21/00

[52] U.S. Cl. ..... 355/298; 355/210; 355/212; 355/326

[58] Field of Search ..... 355/326, 327, 210, 212, 355/245, 200, 296, 298

[56] References Cited

U.S. PATENT DOCUMENTS

| | | | |
|---|---|---|---|
| 4,563,076 | 1/1986 | Takahashi et al. | 355/212 X |
| 4,690,544 | 9/1987 | Forbes et al. | 355/299 |
| 4,806,967 | 2/1989 | Newbury | 355/210 |
| 4,873,554 | 10/1989 | Greco | 355/200 X |

FOREIGN PATENT DOCUMENTS

| | | | |
|---|---|---|---|
| 0351894 | 1/1990 | European Pat. Off. | 355/210 |
| 0370455 | 3/1990 | European Pat. Off. | 355/210 |
| 56-150782 | 11/1981 | Japan . | |
| 60-75850 | 4/1985 | Japan . | |
| 60-76766 | 5/1985 | Japan . | |
| 60-95456 | 5/1985 | Japan . | |
| 60-95458 | 5/1985 | Japan . | |
| 60-158475 | 8/1985 | Japan . | |
| 61-100700 | 5/1986 | Japan . | |
| 61-149972 | 7/1986 | Japan . | |
| 63-48350 | 9/1988 | Japan . | |

*Primary Examiner*—R. L. Moses

*Attorney, Agent, or Firm*—Frishauf, Holtz, Goodman & Woodward

[57] ABSTRACT

The invention provides an apparatus for forming a color toner image on a photoreceptor belt. The photoreceptor belt is stretched to form a loop around a plurality of rollers and installed in a cartridge which is made to be detachable from the apparatus. The cartridge is made to additionally house a container for collecting residual toner removed from the photoreceptor belt or a toner supply unit for supplying toner to a plurality of developing devices.

21 Claims, 20 Drawing Sheets

COLOR IMAGE FORMING APPARATUS HAVING A FREELY INSTALLABLE AND DETACHABLE PROCESS CARTRIDGE

BACKGROUND OF THE INVENTION

The present invention relates to a color image forming apparatus in which a toner image can be formed on a belt-like image forming body in an electrophotographic way and transferred to a transfer material to reproduce an image.

There have been many prior disclosures about reproduction of a color image. The apparatus of a type, for example, in Japanese Patent O.P.I. (Open to Public Inspection) No. 100770/1986 can obtain a color copy in a way such that a latent image is formed and developed on a photosensitive drum which is an image forming body according to a number of color separations of an original. The latent image is transferred onto a transfer drum to form a multi-color image upon every development, and is then transferred to a sheet of recording paper. In addition to the photosensitive drum, the apparatus of the type described needs an additional transfer drum of a size on which one sheet of image can be transferred. It is therefore necessary to make the apparatus large in size and complicated.

The apparatus of another type, for example, in Japanese Patent O.P.I (Open to Public Inspection) No. 14992/1986 can obtain a multi-color copy in a way such that a latent image is formed and developed on a photosensitive drum according to a number of color separations of an original, the latent image being transferred onto a transfer material upon every development. In the apparatus of the type described, however, it is difficult to precisely overlap a number of color image components to obtain a quality color copy.

The apparatuses of the other type proposed by the applicant in Japanese Patent Application O.P.I. Nos. 75850/1985, 76766/1985, 95456/1985, 95458/1985 and 158475/1985 can obtain a color image in a basic multicolor image forming process such that latent image formation and color toner development are repeated a number of times equal to the number of color image separations on a photosensitive drum, the color toner images being overlapped on the photosensitive drum, and transference then being made. In the multi-color image forming apparatuses of the type described in which the overlapping method is used, a plurality made. In the multi-color image forming apparatuses of the type described in which the overlapping method is used, a plurality of developing means for different colors ar provided around the photosensitive drum which usually has to be revolved a multiple number of times to develop the latent image thereon to produce the color image.

It has been proposed that the image forming body be the photosensitive drum mentioned above, with a photoconductive material is coated or evaporated on an outside portion thereof. There also was proposed a belt-like image forming body on which the photoconductive material is coated or attached on a flexible belt. The belt-like image forming body (hereinafter referred to as the photosensitive belt) is effective to make use of possible space limitations because its shape can be determined by the photosensitive belt provided between revolving rollers including a drive roller. This allows the color image forming apparatus to be made compact.

The photosensitive belt can be run along a small curvature with use of the revolving roller of a small diameter. The small curvature portion can be used to separate a transferring material. This prevents insufficient separation of the transferring material.

The photosensitive drum of another type proposed, for example, in Japanese Patent Application O.P.I. No. 48350/1988 is made in the way such that the photosensitive drum can collect used toner therein. Also, the used toner collecting container of a type proposed, for example, in Japanese Patent Application O.P.I. No. 150782/1981 can be dispensed of in view of a life balance of the amount of used toner in a photosensitive drum and photosensitive paper wrapped on it. These proposals aim at making the apparatus small in size and compact.

However, in both of the above-described used toner collecting apparatuses, the types and materials of the photosensitive drums are related to service life of the apparatuses. Particularly, a toner carrying mechanism for carrying the toner to a revolving drum body is complicated, being defective in leakage and splashing of the toner. The used toner collecting apparatuses cannot always be made compact at low costs.

The color image forming apparatus using the photosensitive belt described above has image forming means, including an electricity charging means, an image exposing means, a plurality of developing means, and cleaning means, provided to be faced primarily with a lower outside portion of the photosensitive belt. These image forming means are integrated together with the photosensitive belt into a single module in the form of a process cartridge so that it can be independently attached to or detached from the main body.

Accordingly, a toner supply container containing a toner supply for the developing means and a closed used toner container for containing the used toner collected by the cleaning device have to be provided at positions where they can be functionally coupled with the process cartridge. It is however difficult to integrate them with the developing means and cleaning device in view of different service lives and maintenance service work.

In view of the foregoing, it is a first object of the present invention to provide a color image forming apparatus in which a toner supply container and a closed used toner container can be easily attached to or detached from a process cartridge as necessary.

Further in view of the foregoing, if many image forming means are integrated into a single module, the cartridge is made large and heavy. It is not only difficult to attach to or detach from the main body, but also inconvenient in connection with maintenance service as every image forming means is different in service life and maintenance frequency. Accordingly, it is a second object of the present invention to propose a color image forming apparatus in which the image forming means such as the photosensitive belt can be attached to or detached from the main body in a very easy way so that they will not interfere each other with respect to maintenance and checking.

Other objects of the invention will become obvious from the contents of the specification herein after disclosed

SUMMARY OF THE INVENTION

Briefly, the foregoing first object is accomplished in accordance with aspects of the present invention by a color image forming apparatus having a belt-like image forming body arranged between a plurality of revolving rollers and a plurality of developing means adjacent to each other in the vicinity of an outside of the belt-like image forming body, at least the belt-like image forming body comprising a cartridge attachable to or detachable from the main body, and a toner supply container unit comprising a plurality of toner supply containers for supplying toner to the developing means being attachable to or detachable from the cartridge mounted in position.

On another embodiment it is possible to make the detachable cartridge include at least the belt-like image forming body and the toner supply container unit, with the toner supply container unit being made detachable from the cartridge when the cartridge is dismounted from the main body of the color image forming apparatus.

Also, the foregoing first object is accomplished in accordance with aspects of the present invention by a color image forming apparatus having a detachable cartridge comprising a plurality of revolving rollers, a guide member faced with the plurality of developing means between the revolving rollers, and a belt-like image forming body arranged between the revolving rollers and slided on the guide member, toner collected by a cleaning means for cleaning the belt-like image forming body being collected into a closed used toner container provided on or partly forming the guide member.

Further, the foregoing first object is accomplished in accordance with aspects of the present invention by a color image forming apparatus having a cartridge comprising a used toner collecting container inside a belt-like image forming body arranged between a plurality of revolving rollers, and a cleaning means arranged around the belt-like image forming body, toner collected by the cleaning means being collected by a carrying means through a toner collecting port provided in the toner collecting container, and the cartridge being attachable to or detachable from the main body.

In the abovementioned apparatus, to make the apparatus fully and effectively utilize the space in the used toner container and in order to correct the used toner smoothly in any time, the cartridge is provided with a handle at one side thereof, and the used toner container is provided with an inlet for correcting the used toner at a side corresponding to the one side of the cartridge.

The used toner recovery efficiency is improved by providing a toner distribution means for evenly distributing the used toner in the container.

The foregoing second object is accomplished in accordance with aspects of the present invention by a color image forming apparatus having a plurality of developing means provided to be faced with a lower outside of a belt-like image forming body arranged and moved between plural revolving rollers arranged laterally, a means for moving the belt-like image forming body upward to separate it from the plurality of the developing means, and a means for moving the belt-like image forming body in a parallel direction perpendicular thereto.

Also, the foregoing second object is accomplished in the abovementioned apparatus by providing means for moving the plurality of developing means downward to separate it from the belt-like image forming body and means for moving the plurality of developing means in a parallel direction perpendicular to the downward movement.

BRIEF DESCRIPTION OF THE DRAWINGS

These and other objects and features of this invention will be better understood upon consideration of the following detailed description and the accompanying drawings in which.

DETAILED DESCRIPTION OF THE PREFERRED EMBODIMENTS

Figure 1:
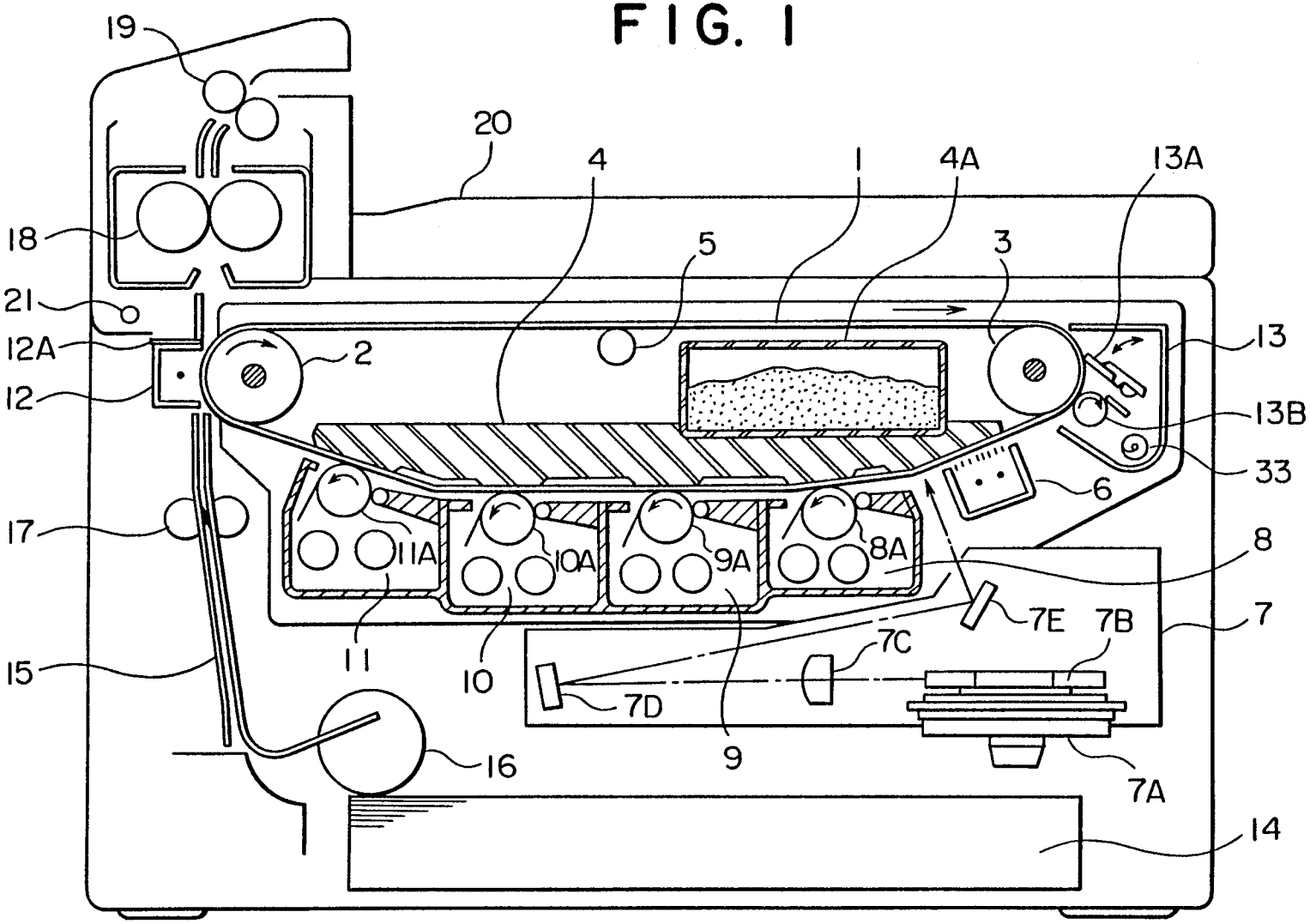
FIGS. 1 and 4 show cross-sectional illustrative views of a first embodiment of a color image forming apparatus according to the present invention.
Figure 2:
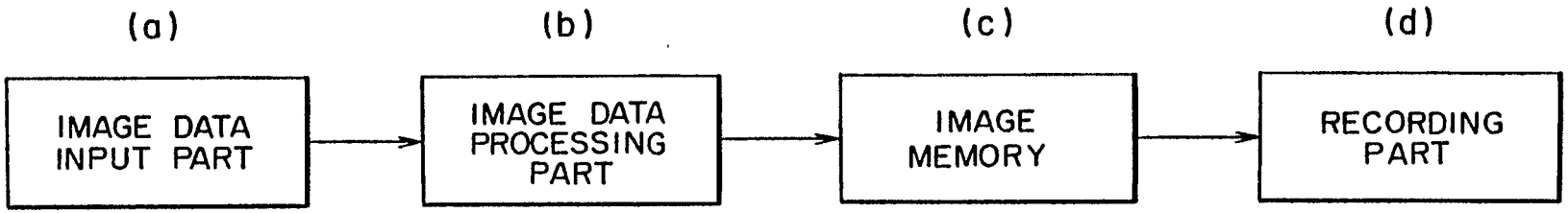
FIG. 2 is a block diagram illustrating an image forming system.

In describing the preferred embodiments of the present invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

A preferred embodiment of the color image forming apparatus according to the present invention is shown in FIGS. 1 through 6. In FIG. 1, a flexible photosensitive belt 1, can form an image. The photosensitive belt 1 which is fitted on revolving rollers 2 and 3, is moved by the revolving roller 2 clockwise.

The photosensitive belt 1 is- made to and tense to slide on a guide member 4 with an inside portion thereof by an action of a tension roller 5. A photoconductor layer on an outside portion of the photosensitive belt 1 therefore can be kept at a certain distance from the outside portion of the guide member 4 during the carrying motion. This provides a stable image forming surface.

An electric charger 6 is a scorotron charger, a laser writing unit 7 is an image exposing means, and a plurality of developing means 8 through 11 contain developing agents of specific colors. These image forming means face with the photosensitive belt 1 on the guide member 4. The photosensitive belt 1 is fitted to the guide member 4 by means of gap forming means pressing the outside thereof so that a gap can be kept between the photosensitive belt 1 and the developing arrangements 8 through 11 so as not to disturb the moving of the photosensitive belt 1.

Instead of the optional laser writing unit 7, shown an optical system in which an light emitting section and a fibre lens array are integrated can be used.

Each of the developing means 8, 9, 10, and 11 can contain the developing agents of specific colors, such as yellow, magenta, cyan, and black, respectively. It has developing sleeves 8A, 9A, 10A, and 11A, respectively, which can keep the photosensitive belt 1 a constant distance from the respective developing means 8, 9, 10, and 11. The developing means 8, 9, 10, and 11 can develop a latent image on the photosensitive belt 1 in a noncontact developing way. Unlike contact development, the noncontact developing method provides an advantage in that the developing means does not prevent motion of the photosensitive belt 1.

A transfer unit 12, a neutralizing bar 12A, and a cleaning unit 13 are provided. A blade 13A of the cleaning unit 13 and a toner carrying roller 13B are kept in position separated from the outside of the flexible photosensitive belt 1 while the image is being formed. They can be pressed to the outside of the flexible photosensitive belt 1 only during cleaning, after completion of the image transference, as shown in the drawing.

The color image forming apparatus of the present invention is made by the process described below. First, forming of a multicolor image in the present preferred embodiment can be accomplished in accordance with an image forming system shown in FIG. 2. That is, an original image is scanned and converted to color image data by a pickup device. The color image data is taken into the image data input part (a) in FIG. 2. The data obtained through the image data input part (a) is calculated by the image data processing part (b) having a calculation feature to produce image data. The image data is stored in an image memory (c). Upon recording, it is sent to a color recording part (d), such as the color image forming apparatus shown as the preferred embodiment in FIG. 1.

More specifically, a color signal output of an image reading apparatus separated from the printer is sent to the laser writing unit 7 shown in FIG. 1. A semiconductor laser of the laser writing unit 7 then emits a laser beam. The laser beam is rotationally scanned by a polygonal mirror 7B, is passed through a f-theta lens 7C, is folded by the mirror 7D and the mirror 7E, and is projected on the outside surface of the flexible photosensitive belt 1 which has been charged in advance by the electric charger 6, as charging means to draw a bright line thereon.

On the other hand, when scanning starts, the laser beam is detected by an index sensor and is modulated by a first color signal. The modulated laser beam scans the outside surface of the flexible photosensitive belt 1. The main scanning by the laser beam and the subscanning by the motion of the flexible photosensitive belt 1 allow formation of a latent image corresponding to the first color on the outside surface of the flexible photosensitive belt 1. The latent image can be developed on the outside surface of the flexible photosensitive belt 1 as toner image by a developing means 8 having a yellow toner which is a developing medium. The resulting toner image passes under a cleaning unit 13 which is separated from the outside surface of the flexible photosensitive belt 1 while the toner image is kept thereon. It then enters a succeeding copy cycle.

In the copy cycle, the flexible photosensitive belt 1 is charged again by the electric charger 6. Then, a second color signal output from the image data processing part is sent into the laser writing unit 7. The color signal is written onto the outside surface of the flexible photosensitive belt 1 as was the case with the first color signal to form a latent image. The latent image is developed by a developing means 9 having a toner of a second color magenta contained therein. The magenta toner image can be formed under existence of the yellow toner image described above.

A developing means 10 contains a cyan toner which can form a cyanic toner image on the outside surface of the flexible photosensitive belt 1 on the basis of a control signal generated by the image data processing part.

A developing arrangement 11 contains a black toner which can overlap a black toner image to form on the outside surface of the flexible photosensitive belt 1 in a similar way.

Each sleeve of developing means 8, 9, 10, and 11 has a dc bias or ac biased dc bias voltage applied thereto which make one or two components of the developing agents jump. This allows noncontact development on the flexible photosensitive belt 1 substrate which is grounded.

The color toner image formed on the outside surface of the flexible photosensitive belt 1 in that way is transferred on to a transference material fed through a paper feed guide 15 from a paper feed cassette 14.

A top sheet of the transference material contained in the paper feed cassette 14 can be carried by a revolution of a paper feed roller 16, and can be fed through a pair of timing rollers 17 to a transfer unit 12 at of image forming of the image on the flexible photosensitive belt 1.

The transference material having the image transferred can be securely separated from the flexible photosensitive belt 1 which abruptly changes its direction along the flexible photosensitive belt. The transference material can then be moved upward, where the image is fixed by a pair of fixing rollers 18, and is finally fed out through a pair of paper exit roller 19 to a tray.

On the other hand, the flexible photosensitive belt 1 which finished the image transference to the transference material can be further carried to a cleaning unit 13. In the cleaning unit 13, the photosensitive belt is pressed by a blade 13A and a toner carrying roller 13B to remove the toner remaining on it. After the removal, the blade 13A is released and a little after this, the toner carrying roller 13B is released to enter a new image forming process.

Figure 3:
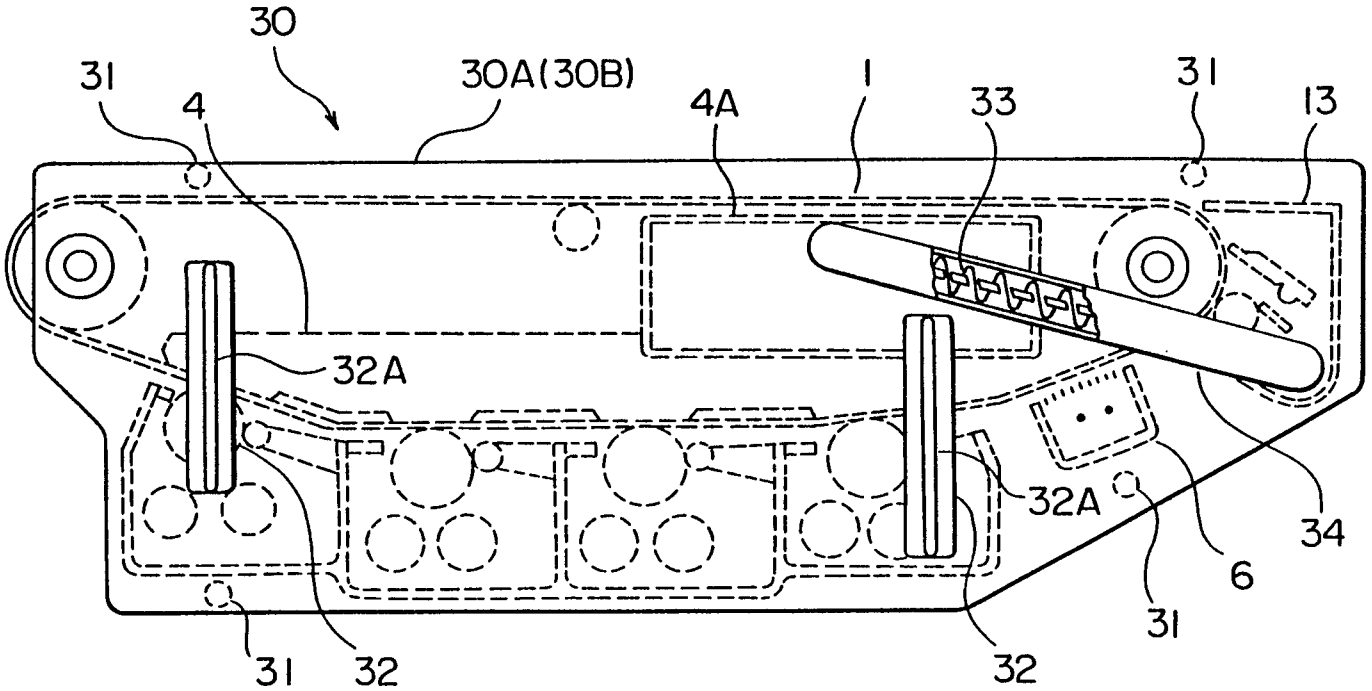
FIGS. 3 and 5 are cross-sectional illustrative front and rear views of the cartridge accommodated in the apparatus, respectively.

The image forming means, including the flexible photosensitive belt 1, the guide member 4, the electric charger 6, the developing means 8, 9, 10, and 11, and the cleaning unit 13, as shown in FIG. 3, are assembled in a cartridge 30 comprising a front panel 30A and a rear panel 30B which can be detachably assembled in a main body of the color image forming apparatus as a unit. The cartridge 30 has the front panel 30A and the rear panel 30B integrated together by four stays 31, and has the image forming means held therebetween. The cartridge 30 can be vertically inserted downward into the main body along three guide rails 32 on front and rear sides thereof.

Each of the guide rails 32 has a convex rail 32A, while the main body has concave rails (not shown). Fitting of the convex and concave rails will allow transmission of power from the main body to the image forming means and connection of electric power.

Figure 4:
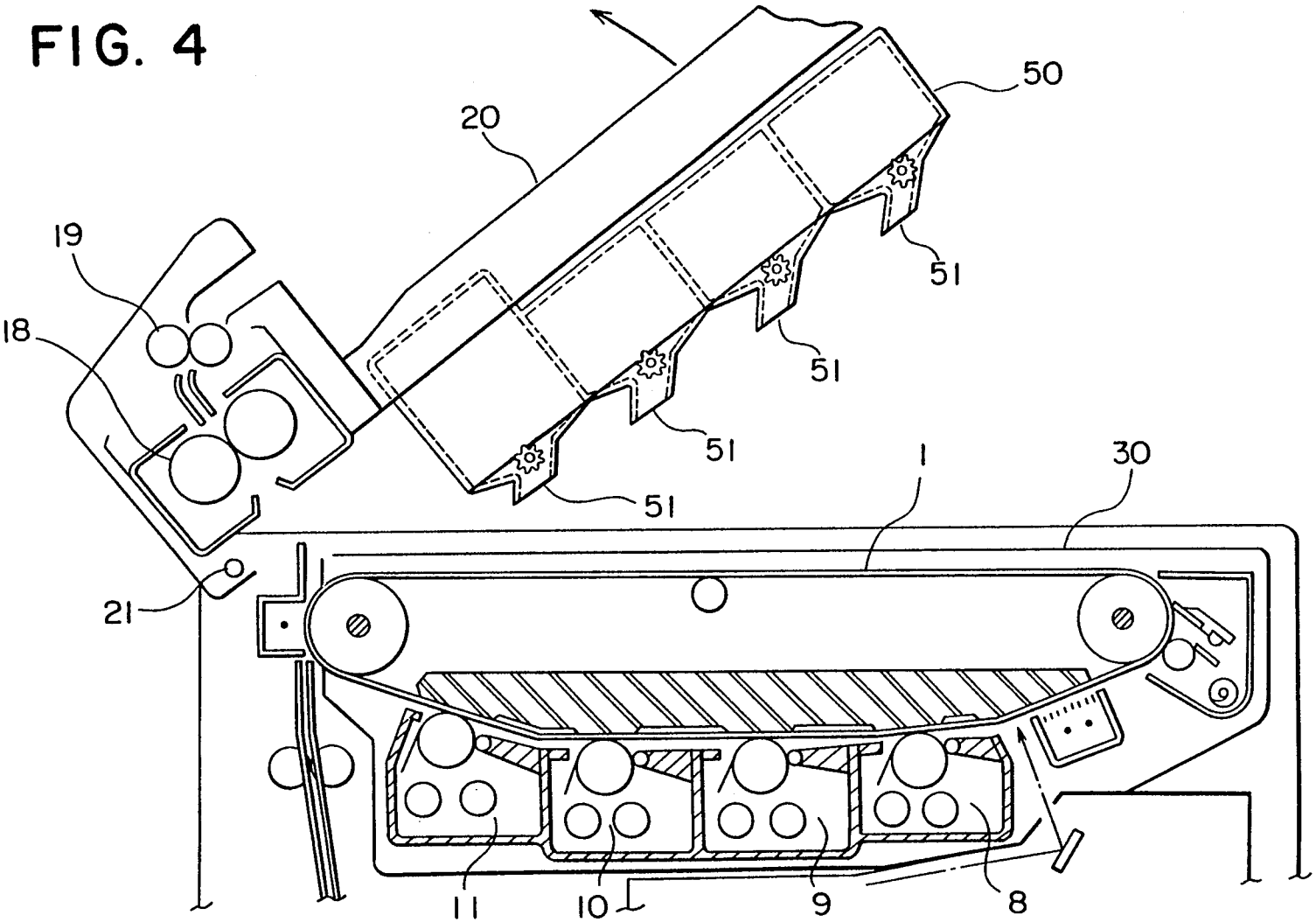

The main body, as shown in FIG. 1, is constructed so that the tray can be opened substantially upright in the arrow direction shown by an arrow in FIG. 4 together with the pair of fixing rollers 18 and the pair of paper exit roller 19. This allows vertical attaching and detaching of the cartridge 30 downward.

The tray 20 has a toner container unit 50 mounted therebelow which has toner containers arranged together in series. Each of the toner containers of the toner container unit 50 contain from the left, black, cyanic, magenta, and yellow toners, respectively, corresponding to the developing means 8, 9, 10, and 11.

With the tray closed, the toner container unit 50 can be set in position so that the toners can be supplied through respective toner exit holes 51 provided on the toner containers to respective supply ports 41 provided on a toner supply unit 40 for receiving the toners from the toner container unit 50, with the toner exit holes 51 being faced with the supply ports 41.

Figure 5:
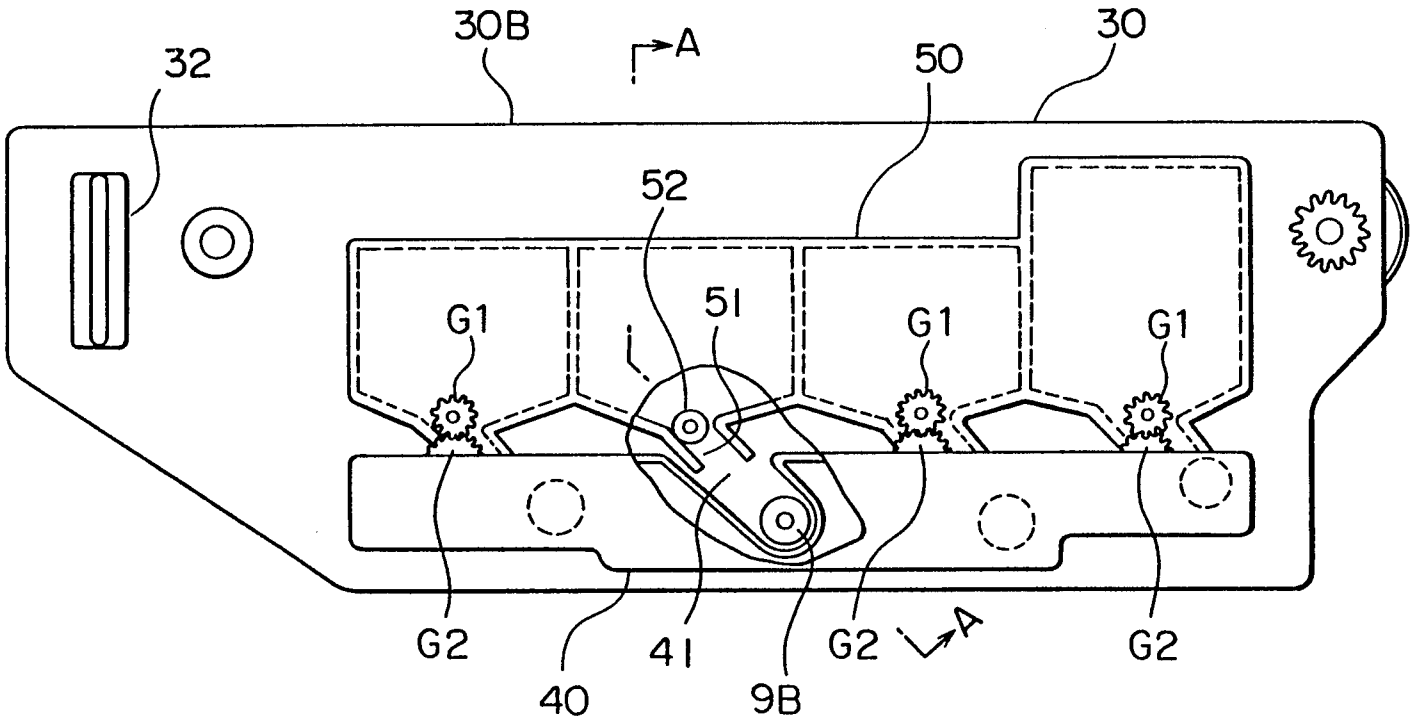

FIG. 5 shows a rear view of the cartridge 30 with the toner container unit 50 set in position. The toner supply unit 40 is provided behind of the rear panel 30B of the cartridge 30, and is to be connected to the developing means 8, 9, 10, and 11. The toner supply unit 40 has the supply ports 41 to be connected to respective developing means 8, 9, 10, and 11.

Each of the supply ports 41 has an extension part of one of a pair of stirring screws 9B built in the respective developing means 8, 9, 10, and 11. Each of the toners falling from the toner exit holes 51 can be carried into respective the developing means 8, 9, 10, and 11 by the respective stirring screws 8B, 9B, 10B, and 11B. The extension part of each stirring screw can be fitted to the other part of the respective stirring screws 8B, 9B, 10B, 11B positioned at an upper stream of revolution of each developing sleeve in connection the stirring effect.

When the toner container unit 50 is set in position in the toner supply unit 40, a gear G1 coaxially integrated with a supply roller 52 built in each container can be engaged with a gear G2 of the toner supply unit 40.

Operation of supplying the toner into the developing means 9, as an example, by the toner container unit 50 will be described below.

Figure 6A:
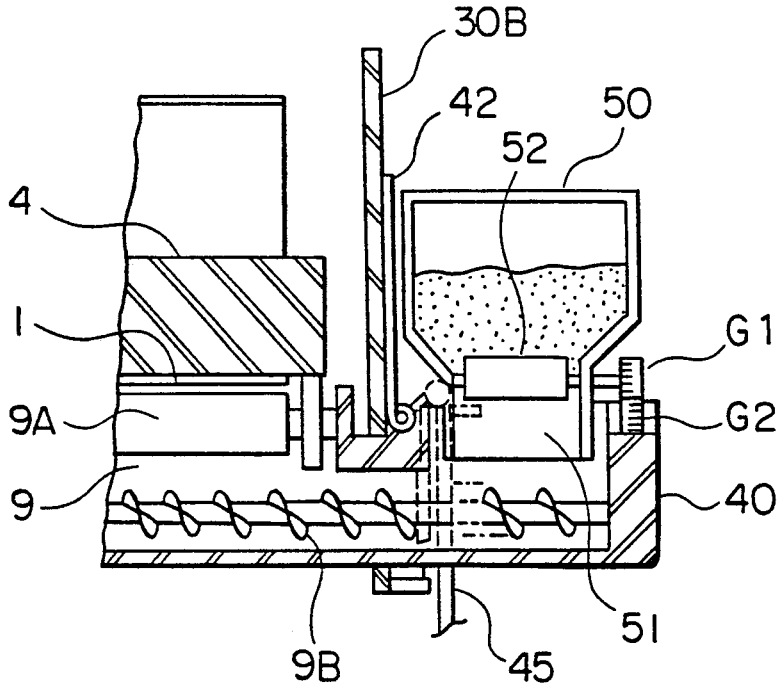
FIGS. 6A, 6B, 6C, and 6D show cross-sectional illustrative views of major parts of the cartridge.

FIG. 6(A) is a cross-sectional view taken across arrows A—A of FIG. 5. The gear G2 is driven by a signal output of the image data processing part depending on a detection results of image density. The supply roller 52 starts revolution through the gear G1 to make the magenta toner of the toner container fall from the toner exit holes 51 into the supply port 41. The magenta toner which has fallen into the supply ports 41 can be carried into the developing means 9 by revolution of the stirring screw 9B. It also can be stirred and mixed by a reverse operation of the other stirring screw. It then can be fed into a developing sleeve 9A to restore the image density.

After restoration of the image density, the gear G2 is stopped by a signal output of the image data processing part depending on a detection result of image density again to finish supply of the toner. This operation can be made intermittently during the developing process.

Figure 6B:
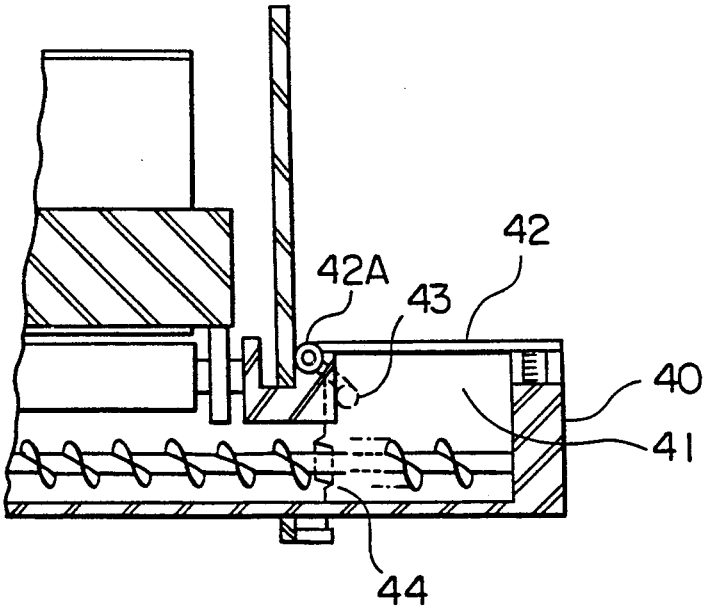
Figure 6C:
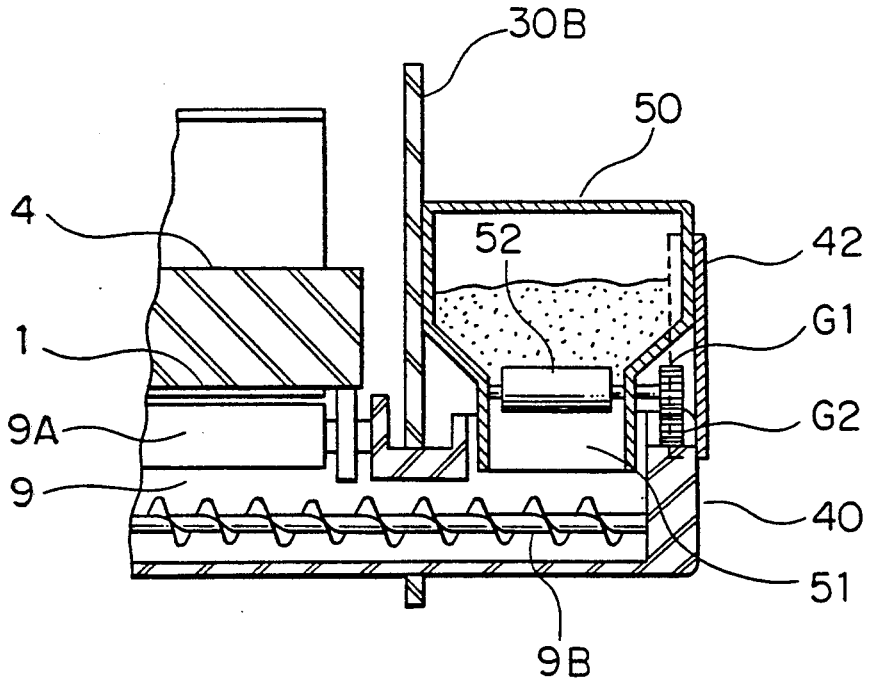
Figure 6D:
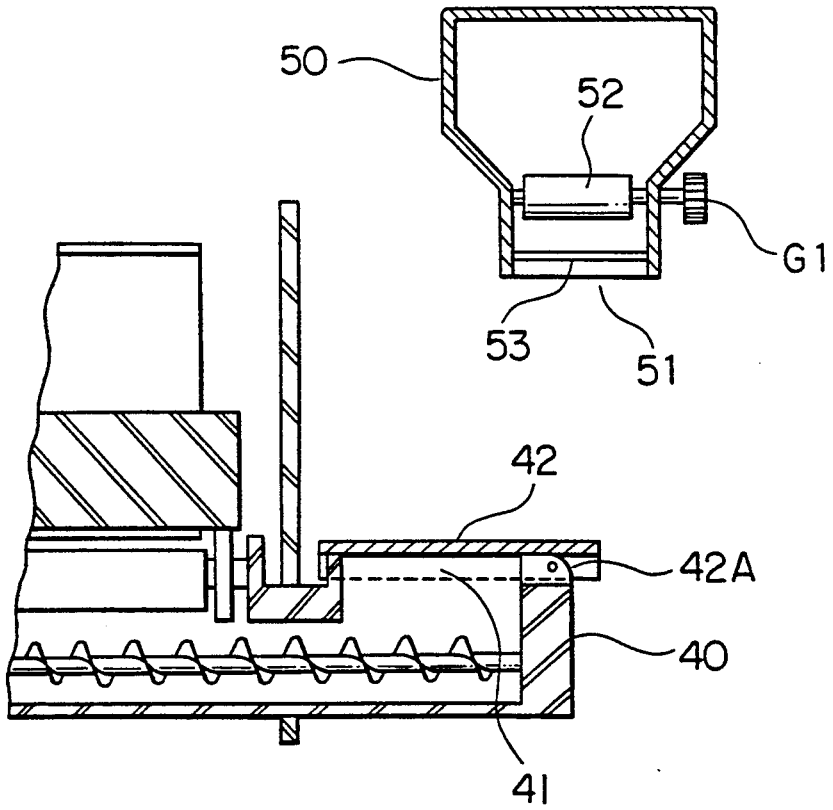

FIG. 6(B) shows a state of the toner supply unit 40 when the cartridge 30 is taken out of the main body. On a top portion of the toner supply unit 40 is provided a turnable turning plate 42 with a fulcrum of a shaft 42A. It is always forced to turn clockwise by action of a tension spring 44 suspended on an arm 43 coaxially integrated therewith. The supply port 41 can be covered by the turning plate 42 when the cartridge 30 is detached as a single unit, thereby preventing the toner from flowing out and preventing foreign matters from intruding therein.

When the cartridge 30 is attached to the main body, as shown in FIG. 6(A), the arm 43 is fitted to a push up lever 45 of the main body to be turned counterclockwise against the force of the tension spring 44. This allows turning the turning of plate 42 to a substantially upright position to make the supply ports 41 open. As the tray 20 is closed, therefore, the toner container unit 50 is reset to the state shown in FIG. 6(A).

With respect to the toner container unit 50, also, when it is not set in position in the toner supply unit 40, the toner exit holes 51 can be automatically closed by shutter plates to prevent the toner from flowing out and splashing.

Now, another embodiment according to the present invention will be described. Namely, in this embodiment where a color image forming apparatus comprises a belt-like image forming body arranged between a plurality of rollers, a plurality of developing devices adjacent to each other in the vicinity of an outside of the belt-like image forming body and a plurality of toner supply container for supplying toner to the plurality of developing devices, there is provided a detachable cartridge for installing at least the belt-like image forming body and the toner supply container therein, and the toner supply container is made detachable from the cartridge when the cartridge is detached from the apparatus.

In a preferable embodiment as shown in FIGS. 3 and 5, image forming means such as the toner container unit 50, the flexible photosensitive belt 1, the guide member 4 the scorotron electric charger 6, the plurality of developing devices and the cleaning devices 13 are installed in the cartridge 30 which is attachable to and detachable from the main body of the image forming apparatus as a unit. FIG. 5 indicates the condition of the cartridge 30, wherein the cartridge 30 includes the toner container unit 50. The cartridge 30 has the front and rear base plates 30A and 30B integrated together with the four stays 31, and incorporates the abovementioned image forming means between the plates 30A and 30B. On the front and rear sides of the cartridge 30 is provided three guide rails 32 through which the cartridge 30 is installed by being vertically inserted from an upper side into the main body.

The members having convex-shaped rails 32A are used as the guide rails 32, and guide rail (not illustrated in the drawings) having a concave-shaped rails are provided in the main body. With the engagement between these rails, power transmission and electric power supply for the image forming means are carried out.

As shown in FIG. 6 (C) which indicates a cross section corresponding to a section designated with an arrow mark A-A in FIG. 5, when the toner container unit 50 is installed in the cartridge 30, the rotatable plate 42 mounted on an end surface of the toner supply portion 40 is used as the guide for the toner container unit 50. Furthermore, the installed position of the toner container unit 50 is regulated by the rotatable plate 42. At this time, the gear G1 coaxially integrated with the supply roller 52 is meshed with the gear G2 at the side of the toner supply portion 40, and the power transmission system is thereby connected.

The supplying of toner to each of the developing devices by the toner supply container unit 50 is explained hereinafter, taking as an example the supplying of toner to the developing device 9.

As shown in FIG. 6 (D), which indicates a condition where the toner supply container unit 50 is detached from the toner supply portion 40, the toner supply container unit 50 can be easily detached by being pulled upwardly after a coupling means (not illustrated in the drawings) is released.

When the toner supply container unit 50 is detached, the shutter plate 53 is actuated to close the toner exit holes 51. On the other hand, the supply ports 41 of the toner supply portion 40 is closed with the rotatable plate 42 by rotating it around a supporting shaft 42A as a fulcrum point in the counterclockwise direction, thereby preventing toner leakage, toner scattering and foreign material contamination.

Incidentally, when the cartridge 30 is attached to or detached from the main body, the tray 20 is overhauled by being turned together with the fixing roller 18 and the sheet delivery roller 19 in the counterclockwise direction around the hinge 21 so that the cartridge 30 is vertically upwardly lifted and released by engagement with the guide rail 32.

In the abovementioned embodiment, the cartridge 30 is made detachable together with the belt-like photosensitive body and the developing devices, however, it is also possible to make it detachable together with the toner supply container and the belt-like photosensitive devices. With this arrangement, even if the elements installed in the cartridge differ from each other in the maintenance intervals and the endurance life periods, the maintenance of the apparatus may become possible by replacing them with the spare one.

In turn, a toner collecting arrangement according to the present invention will be described below. The cartridge 30, as shown in FIG. 3, has a toner carrying pipe 34 with a toner carrying screw 33 provided at its front side. One end of the toner carrying pipe 34 is made open at a bottom of the cleaning unit 13, and the other end is connected to a closed toner collecting container 4A which is a part of the guide member 4, thereby allowing the cleaning unit 13 to drive out the collected toner.

The toner carrying screw 33 can be driven to revolve by a power from the main body to feed the toner collected by the cleaning unit 13 through the toner carrying pipe 34 to the closed toner collecting container 4A.

The closed toner collecting container 4A, as shown in FIG. 3, can be made smaller one occupy a part of the guide member 4 or larger use the guide member 4 itself as an accommodation box depending on a life expectancy of the cartridge 30. As a result, when the image forming means reach their life expectancy, the closed toner collecting container 4A is filled with the collected toner. It is therefore possible to fully use all arrangements and materials of the cartridge 30 during its life expectancy before it is replaced.

Figure 10:
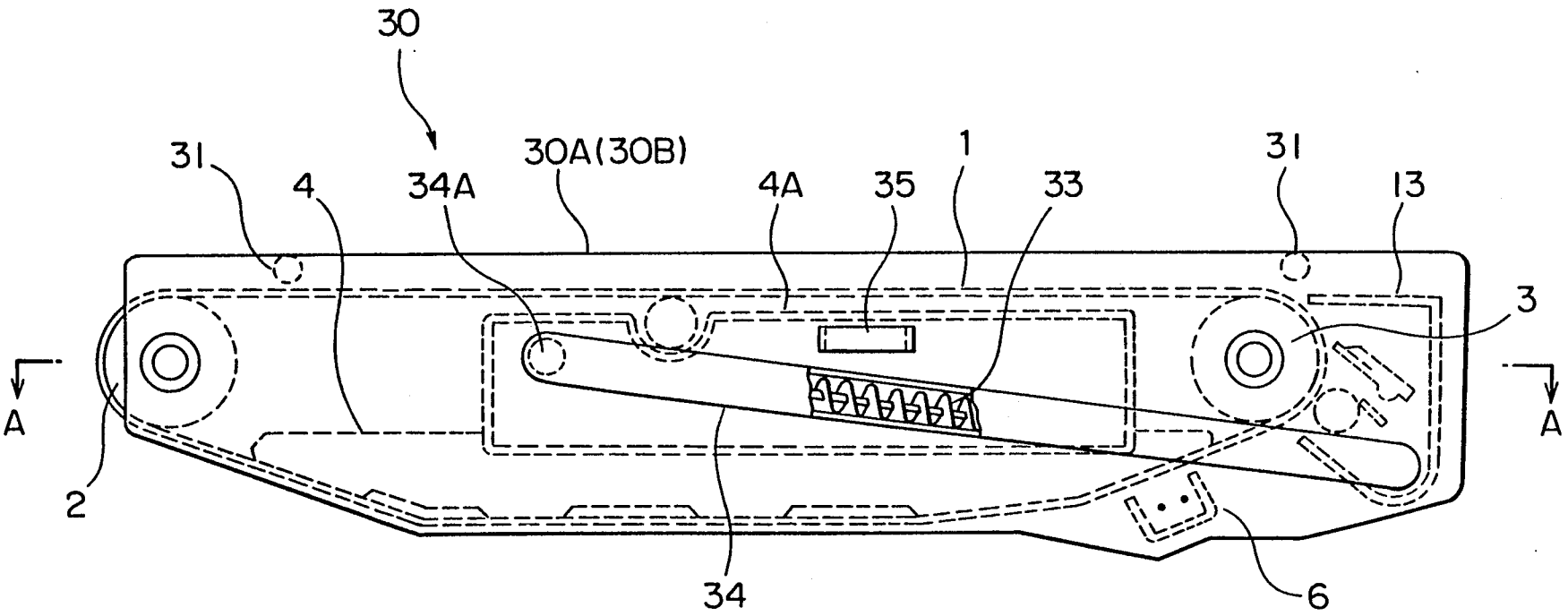
FIGS. 10, 11, and 13 are cross-sectional illustrative views of the cartridge accommodated in the apparatus.

In the construction described above, all the arrangements of the cartridge 30 including the developing means is integrated into one module which can be attached or detached. However, as shown in FIG. 10, it is possible to integrate the guide means, belt-like image forming body, cleaning arrangement container, and the like together, excluding the developing means; and the integrated module can be attached or detached. This construction allows easy maintenance with ready replacement of elements of the cartridge which are shorter or different in service life or maintenance period.

It is to be understood that the form of the invention herewith shown and described is to be taken as a preferred embodiment. Various changes may be made in the shape, size and arrangement of parts. For example, equivalent elements may be substituted for those illustrated and described herein, parts may be reversed, and certain features of the invention may be utilized independently of the use of other features, all without departing from the spirit of scope of the invention as defined in the subjoined claims. It is intended, therefore, that all matter contained in the foregoing description and in the drawings shall be interpreted as illustrative only and not as limitative of the invention.

In the above-described construction of the color image forming apparatus according to the present invention which uses the belt-like image forming body and has image forming means, including the plurality of the developing means, integrated into the single cartridge, the toner container accomplished herein can be readily attached or detached by means of a very easy handling process in a way such that the cartridge is made to be a module. As a result, each of the image forming means can be independently replaced depending on its life expectancy. It is very advantageous in view of service, maintenance, and economy.

Also, in the color image forming apparatus according to the present invention which has the belt-like image forming body, the toner collected can be contained by use of the space of the image forming body in a way similar to that of a color image forming apparatus having a drum-like image forming body. As a result, the color image forming apparatus can be made compact while being capable of containing a large amount of the collected toner.

The color image forming apparatus according to the present invention provides the following differences and advantages as compared with the previous color image forming apparatus in which the used toner is collected in a photosensitive drum.

(1) A used toner collecting container is placed in a space inside the photosensitive belt. It can be freely shaped depending on a shape of the photosensitive belt. More specifically, the photosensitive belt can be arranged to any length and any shape as desired, and the used toner container can be made to any size and any shape at any position depending on the photosensitive belt. The used toner collecting container can be designed so that it can be virtually filled with the used toner during the life expectancy of the photosensitive belt of a cartridge type. A low cost machine can be accomplished since the whole cartridge then can be discarded for replacement. For a high class machine the photosensitive belt of which provides a long life expectancy, the used toner collecting container can be made to be taken out of the cartridge to be discarded. In short, the machine can be designed compactly to a desired specification depending on the life expectancy of the photosensitive body.

(2) Unlike the machine in which the used toner collecting box is placed inside the photosensitive drum, the color image forming apparatus according to the present invention needs no revolving and coupling arrangements in a toner collection path from the cleaning section to the used toner collecting container even when the photosensitive belt is turning. It can therefore be constructed at a low cost using a simple carrying and coupling mechanism which will be free of drop and leakage of the used toner.

(3) When the used toner collecting box is placed inside the photosensitive drum, it is involved in complication and difficulty in replacement arrangements of a rotatable drum, particularly in an arrangement which couples a used toner hose at its intake end. When the used toner collecting box is replaced into the photosensitive drum, it likely happens that the photosensitive body may become dirty or scratched. For the photosensitive belt of the present invention, on the other hand, the whole cartridge can be enclosed by a plastic case with the exception of a side for the used toner collecting container or portions near the cartridge which are made open. This allows a replaceable construction to be made simple, improving the serviceability to a great extent.

(4) In a process where a toner image is overlapped on an image carrier, it is necessary that the photosensitive drum has to have an outside diameter at least to cover a maximum image size. In the photosensitive belt, also, it is necessary that its length has to cover the maximum image size. The photosensitive belt, however, as described previously, can be made to any desired shape. This provides an advantage in the used toner collecting container can be made to any desired shape and size accordingly.

Figure 7:
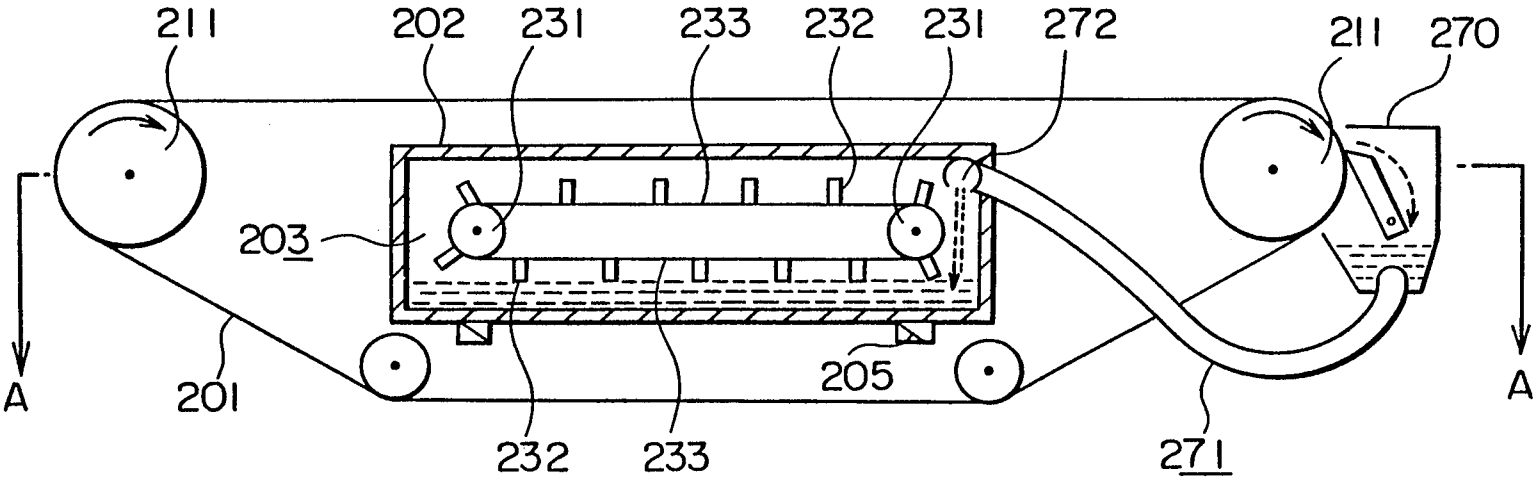
FIGS. 7 and 8 are detailed views of a toner distribution uniforming means of a used toner collecting container.
Figure 8:
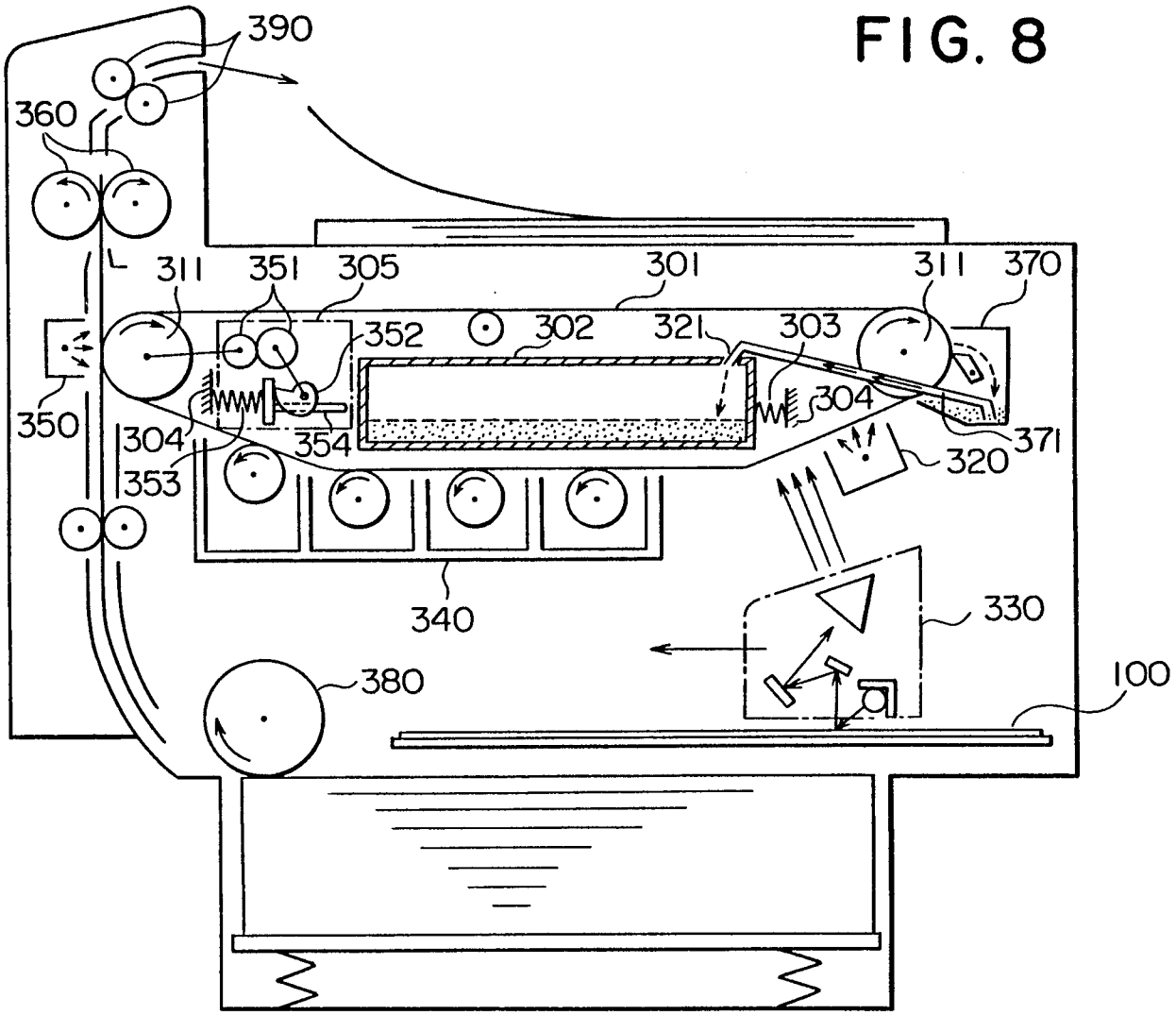

Now, the following paragraphs describe arrangements that allow an effective collection of the used toner into the used toner collecting container shown in FIGS. 7 and 8. In FIG. 7, a recording photosensitive medium 201 is a belt-like turning body. A drive means 211 drives the recording photosensitive medium 201. A used toner collecting container 202 is provided inside the recording photosensitive medium 201. A toner uniforming means 203 which involves the spirit of the present invention is provided within the used toner collecting container 202. The toner uniforming means 203 comprises a drive shaft 231 which can be revolved by the drive means 211 as interlocked therewith and a belt-like carrier 233 which also can be driven by the drive means 211 through drive shaft 231. The belt-like carrier 233 has a plurality of toner moving fins 232 equally separated from each other in a perpendicular direction and in parallel with the drive shaft 231.

A supporting means 205 can support the used toner collecting container 202 on the main body. A cleaning means 270 can remove the toner adhered on the recording photosensitive medium 201 after an end of copying process. A powder carrying means 271 can carry the removed toner to the used toner collecting container 202. The powder carrying means 271 comprises a flexible tube and a flexible wire provided in the flexible tube which has spiral fins. The flexible wire can be revolved by the drive means 211 as interlocked therewith to rotate the spiral fins, which can carry the used toner into the used toner collecting container 202. At the inside of the toner collecting container 202, the powder carrying means 271 has a plurality of small holes for exhausting the powder. The diameters of the small holes are made larger as they become distant from a wall of the used toner collecting container 202 through which the powder carrying means 271 passes. The toner therefore can be dropped from the end 272 into the used toner collecting container 202 in a virtually uniform way in a direction parallel with the drive shaft 231. This is effective to uniformly distribute the toner in the used toner collecting container 202.

While the toner collected in the used toner collecting container 202 can be stirred and made uniform by the toner moving fins 232 provided on the belt-like carrier to 233 driven by the drive shaft 231, it is carried an innermost recess distant from the toner feed port of the used toner collecting container 202. This means that all the space of the used toner collecting container 202 can be effectively used for collection of all the toner.

In FIG. 8, a recording photosensitive medium 301 made up of a belt-like turning body having an organic photosensitive material thereon is shown. A toner collecting container 302 is provided inside the belt-like turning body of the recording photosensitive medium 301. A toner supply port 321 is provided within the toner collecting container 302. An elastic fixing member 303 is provided to elastically fix the toner collecting container 302 to a stationary part 304. An impact exerting means 305, which in the spirit of the present invention is provided to intermittently exert an impact to the toner collecting container 302.

In this embodiment, the impact exerting means 305 comprises a cam 352 turned through the gear 351 and a drive means 311 for driving the recording photosensitive medium 301 as interlocked therewith, a elastic means 353 compressed by the cam 352, and an impact member 354 which can exert an impact to the toner collecting container 302 with use of a repulsion force given when the elastic means 353 is released from the compression state at a step of the cam 352. A frequency of the impact can be set to a desired value in a way that a gear ratio of the gear 351 is properly selected.

A cleaning means 370 is provided to remove the toner adhered on the recording photosensitive medium 301 after an end of a serial copying process. A powder carrying means 371 is provided to carry the toner removed to the toner collecting container 302.

If the toner removed from the recording photosensitive medium 301 after the end of image transference process is put into the toner collecting container 302 by means of the powder carrying means 371 only, the toner will tend to be around the toner supply port 321 of the toner collecting container 302, resulting in nonuniform distribution of the toner in the toner collecting container 302. In the construction described above, the impact exerting means 305 can intermittently exert the impact to the toner collecting container 302 to make the toner distribution uniform in the toner collecting container 302.

The following paragraphs will describe a second embodiment of the arrangement where the cartridge 30 can be attached to or detached from the main body.

Figure 9:
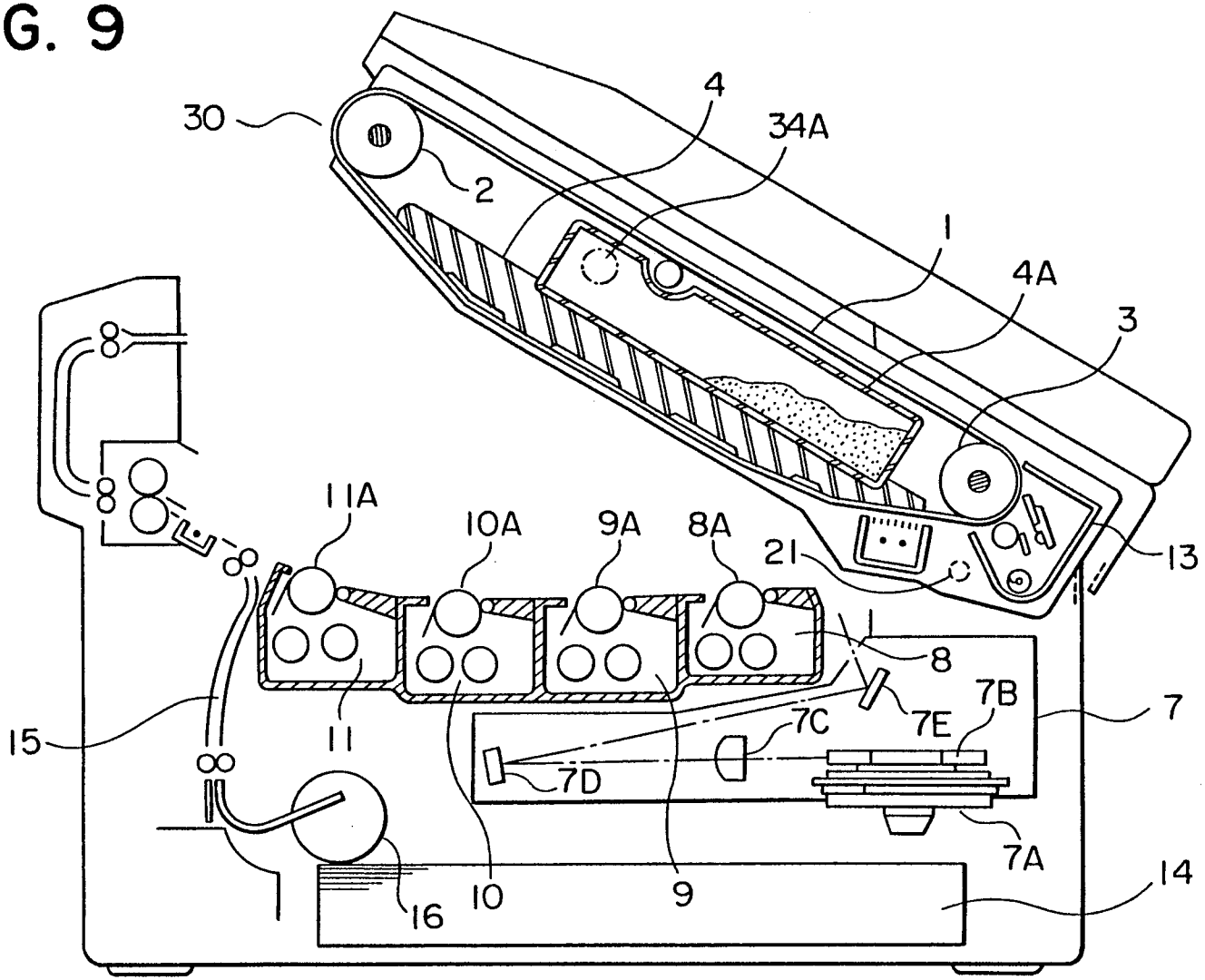
FIGS. 9 and 12 are cross-sectional illustrative views of a second embodiment of a color image forming apparatus according to the present invention.

The color image forming apparatus according to the present invention, as shown in FIG. 9, is made in a clamshell form so that an upper body containing the cartridge 30 can be released and held at an angle with a fulcrum of the hinge 21. The cartridge 30 can be held in a way such that the revolving roller 2 and the revolving roller 3 are fitted on two shafts, a drive shaft and fixed shaft, respectively, projected from the released upper body.

Figure 11:
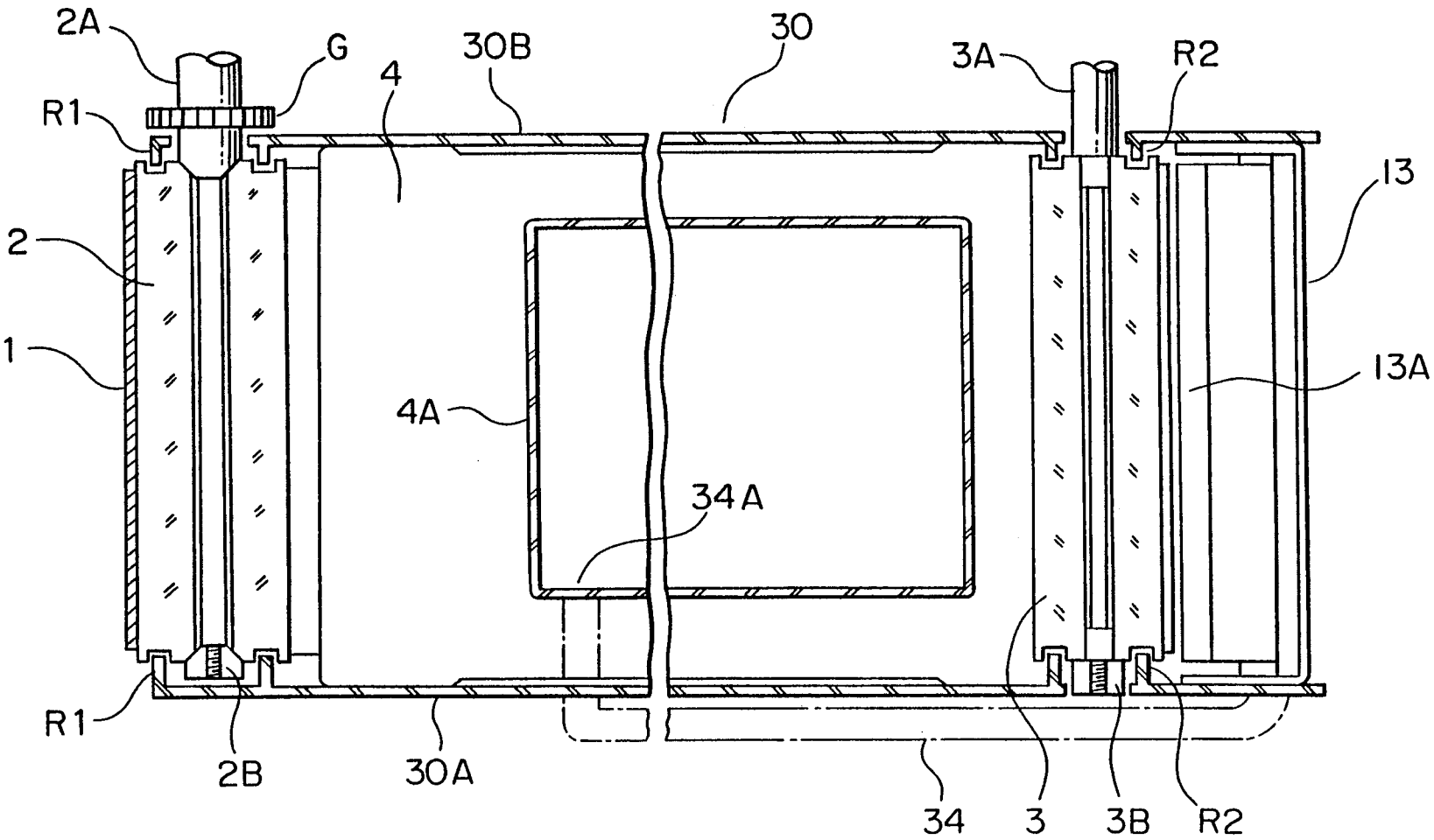

FIG. 11 shows a cross-sectional view of the cartridge 30 taken across arrows A—A of FIG. 10. The revolving roller 2 and 3 are idly supported by ring-like ribs R1 and R2 formed inwardly against each other at the front panel 30A and the rear panel 30B of the cartridge 30, respectively.

On the other hand, the upper body has the drive shaft 2A and the fixed shaft 3A protruded. The drive shaft 2A has a gear G connected to a power system of the main body. With the revolving roller 2 and the revolving roller 3 fitted on the drive shaft 2A and the fixed shaft 3A, respectively, the cartridge 30 can be supported and at the same time, the revolving roller 2 and the revolving roller 3 can be positioned at a certain distance therebetween. This allows the photosensitive surface of the flexible photosensitive belt 1 to be placed in position.

After the drive shaft 2A and the fixed shaft 3A has the revolving roller 2 and the revolving roller 3 pressed on, a nut 2B is tightened to fix the revolving roller 2 to the drive shaft 2A so as to integrate then together, and a nut 3B is tightened on the revolving roller 3 to rotatably hold it on the fixed shaft 3A.

After the cartridge 30 itself is mounted on the upper body, it can be held in a way such that either the front panel 30A or the rear panel 30B is fitted on the upper body.

The cartridge 30 has the toner carrying pipe 34 arranged as a toner carrying means on a front side thereof which has the toner carrying screw 33 therein. The toner carrying pipe 34 has the toner collecting port as one end thereof connected to a bottom of the cleaning unit 13, and the other end 34A is connected to the closed toner collecting container 4A formed on a part of the guide member 4.

The toner carrying screw 33 is driven to revolve by the drive force from the main body to transport the toner collected by the cleaning unit 13 through the toner carrying pipe 34 to the closed toner collecting container 4A.

The toner collecting port 34A has its opening at a left-hand portion of the closed toner collecting container 4A so that it can be positioned at an upper portion of the closed toner collecting container 4A if the upper body is inclined as opened.

The collected toner tends to accumulate around the toner collecting port 34A. When the upper body is opened, however, as shown in FIG. 9, the toner collecting port 34A which is positioned above allows the accumulated toner to drop down in a direction opposite to the toner collecting port 34A to dissolve the toner accumulation.

As a result, the closed toner collecting container 4A can always contain the toner at a mean level so that its containing capacity can be fully used to accommodate a large amount of the collected toner.

Figure 12:
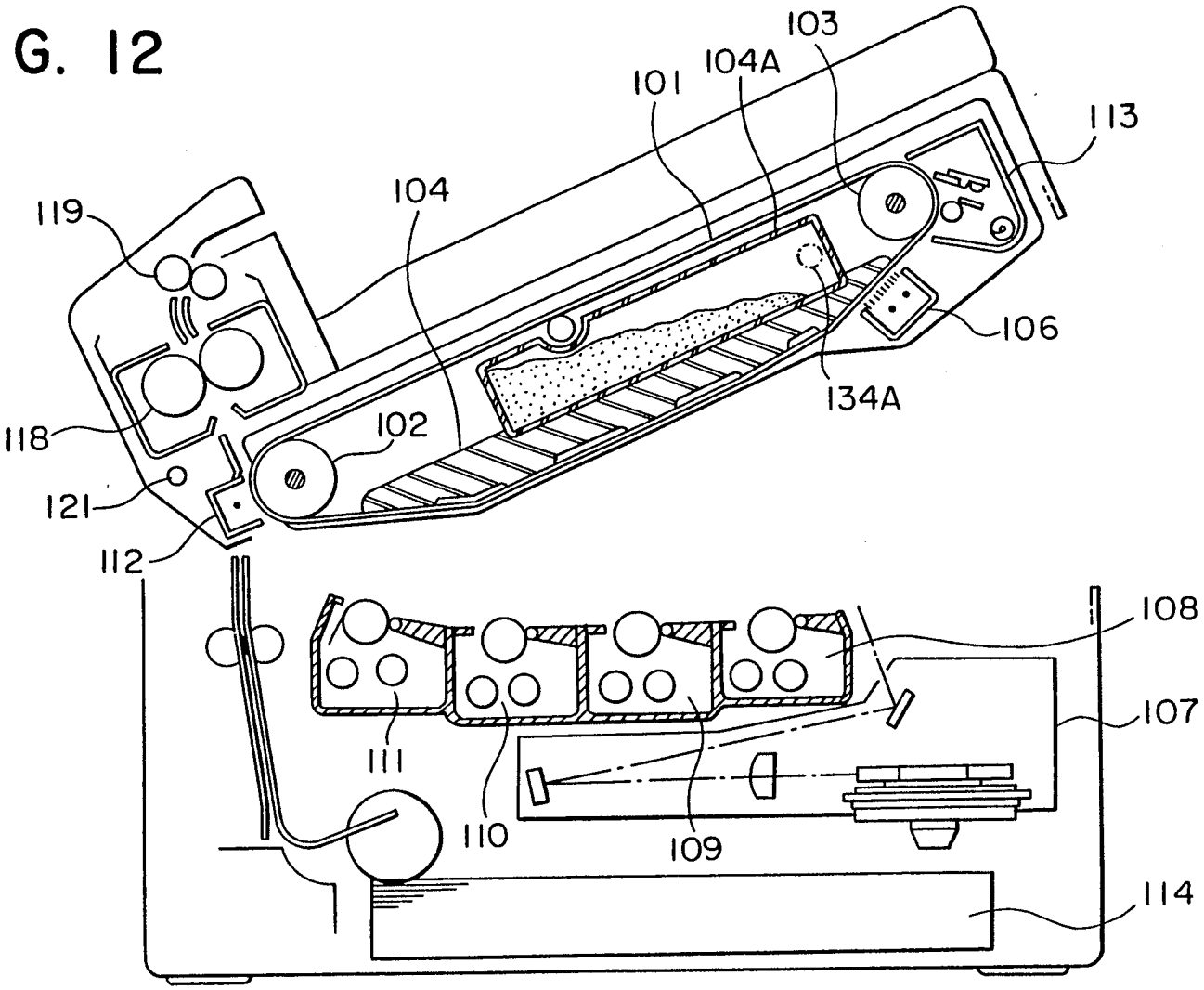
Figure 13:
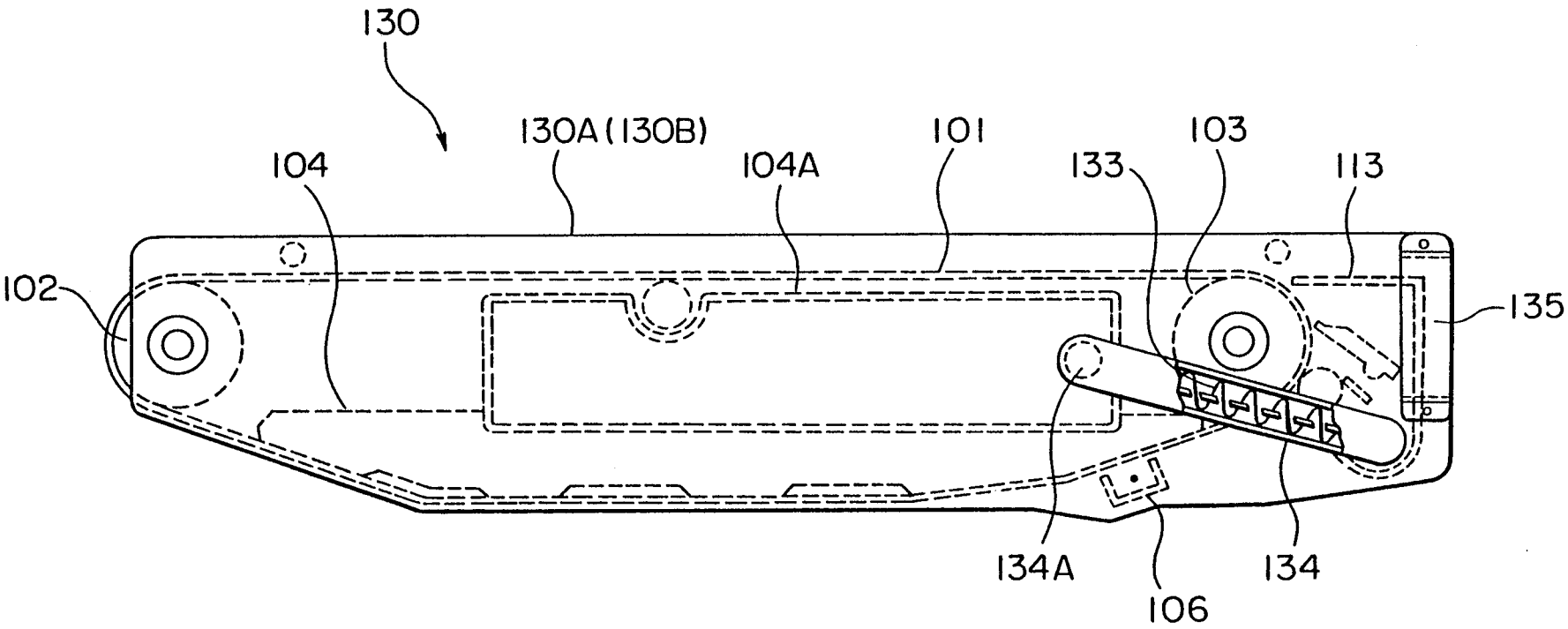

Similarly, in the color image forming apparatus shown in FIG. 12 in which the upper body can be released counterclockwise with a fulcrum of a revolving shaft 121 provided at a left-hand portion of the main body, a toner collecting port 134A is provided at a right-hand portion of a toner collecting container 104A as shown in FIG. 13. The toner collected around the toner collecting port 134A, as shown in FIG. 12, can be moved leftward to dissolve the toner accumulation when the upper body is opened.

If the toner collecting port 134A of the toner collecting container 104A is provided at a right-hand portion near the cleaning means 113, as shown in FIG. 13, it is preferable to also arrange a handle 135 at the right-hand portion near the cleaning means 113. In this construction, the cartridge 30 can be downwardly suspended by the handle 135 if it is removed from the upper body. This allows the used toner accumulated near the toner collecting port 134A to drop to a bottom portion of the toner collecting container 104A, or to a left-hand portion in a state shown in FIG. 12, thereby dissolving the toner accumulation.

The handle 135 may be provided at a center portion of the cartridge 30. The toner contained can be dropped to the backside part of the toner collecting container 104A if it is taken out of the upper body to be suspend downward. The toner collecting port 134A therefore can be provided at either of right- or left-hand position as long as it is on a front side of the toner collecting container 104A.

As far as the opening position of the toner collecting port 134A meets the conditions described above, the opening direction of the upper body with respect to the main body can be either clockwise as shown in FIG. 9, counterclockwise, or from the front side to the backside.

The present invention makes it possible for the used toner collecting container can to evenly contain the used toner up to its containing capacity even if it is shaped horizontally as provided inside the belt-like image forming body. As a result, the color image forming apparatus according to the present invention can collect a large amount of the toner for a long period of time even though its main body is made compact.

The following paragraphs will describe a third embodiment of the invention whereby the cartridge 30 can be attached to or detached from the main body.

Figure 14:
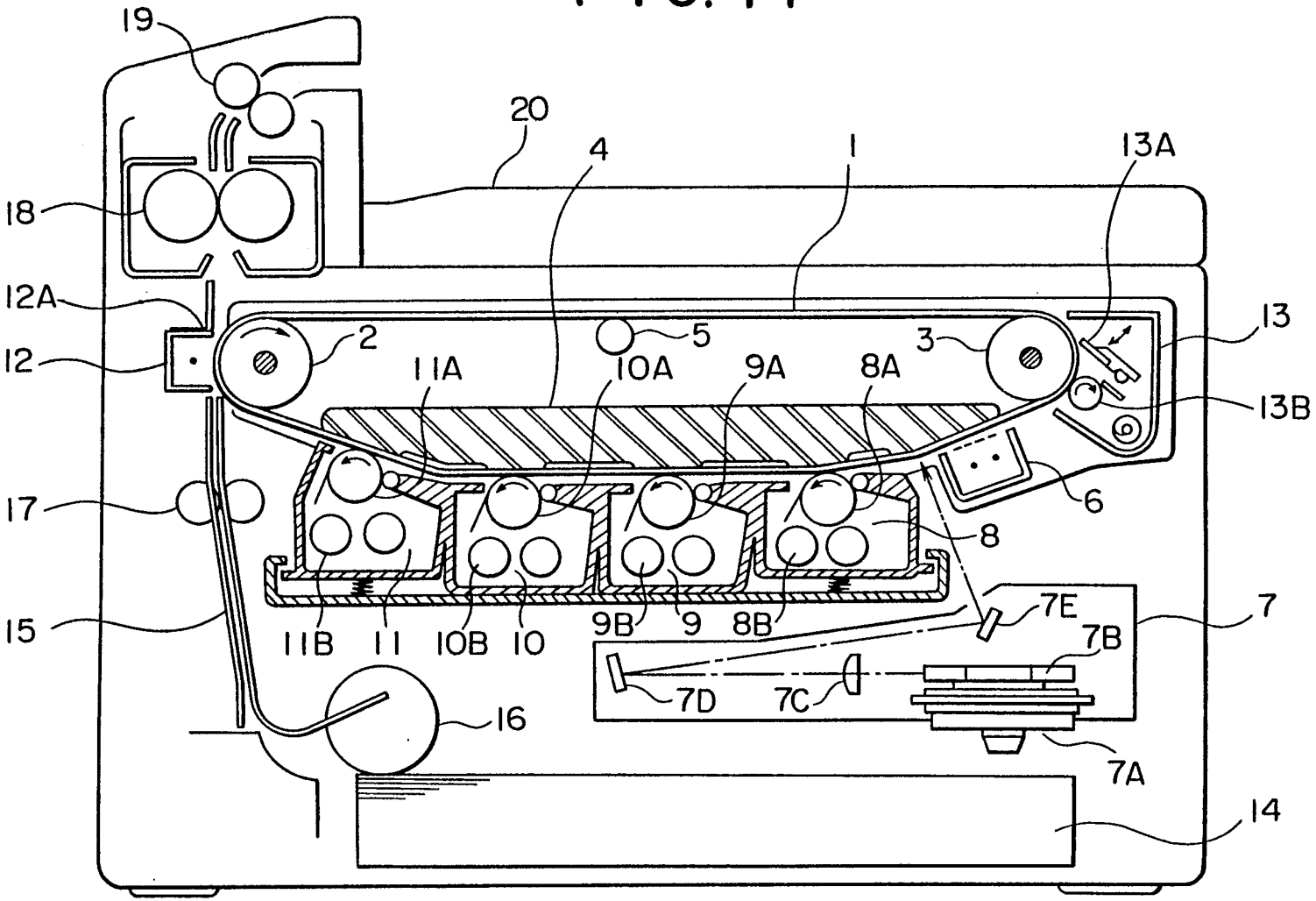
FIG. 14 is a cross-sectional illustrative view of a third embodiment of a color image forming apparatus according to the present invention.
Figure 15:
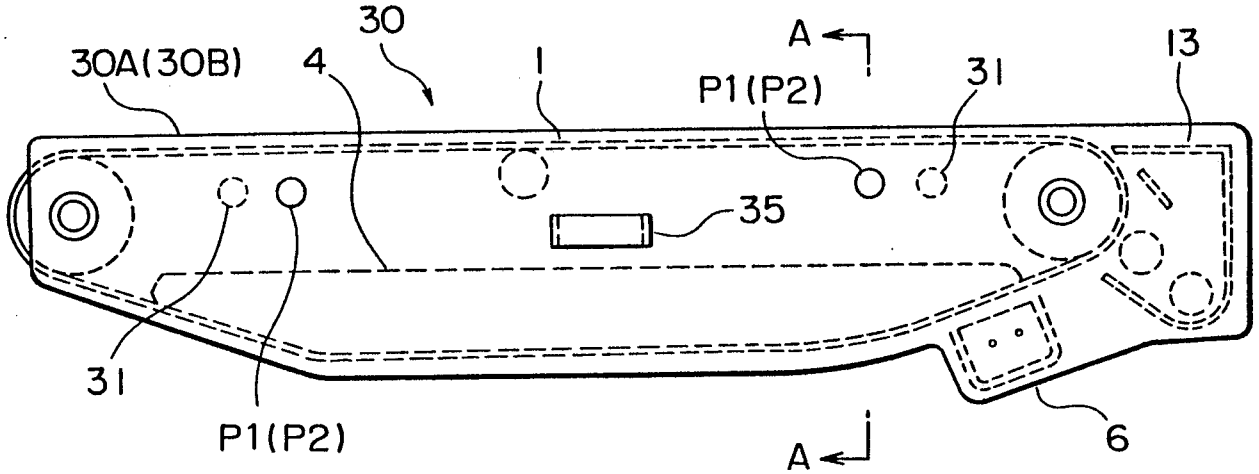
FIGS. 15 and 16 are cross-sectional illustrative front views of a process cartridge and a developing unit accommodated in the apparatus, respectively.
Figure 16:
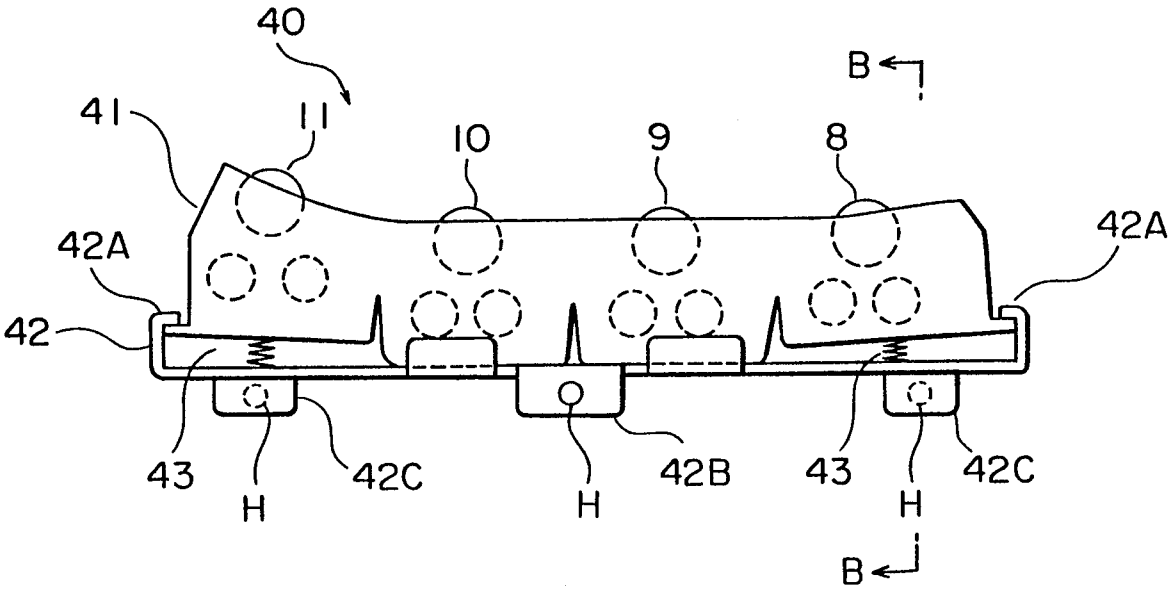

In the third embodiment, as shown in FIGS. 14–16, a developing unit 40, which is incorporated in an integrated flexible developing container 41 and which is mounted on a supporting base 42, can be attached to or detached from the main body.

The developing container 41 has a plurality of compression springs 43 between bases of the developing means 8, 9, 10, and 11 and the supporting base 42. The developing container 41 can be horizontally inserted from a front part of the main body to accommodate a state wherein the developer container 41 is fitted by the pawls 42A so that a curvature of a curved surface formed by connecting tip points of the developing sleeves 8A, 9A, 10A, and 11A is made less than a curvature of the image forming surface of the flexible photosensitive belt 1 formed by the guide member 4.

Figure 17:
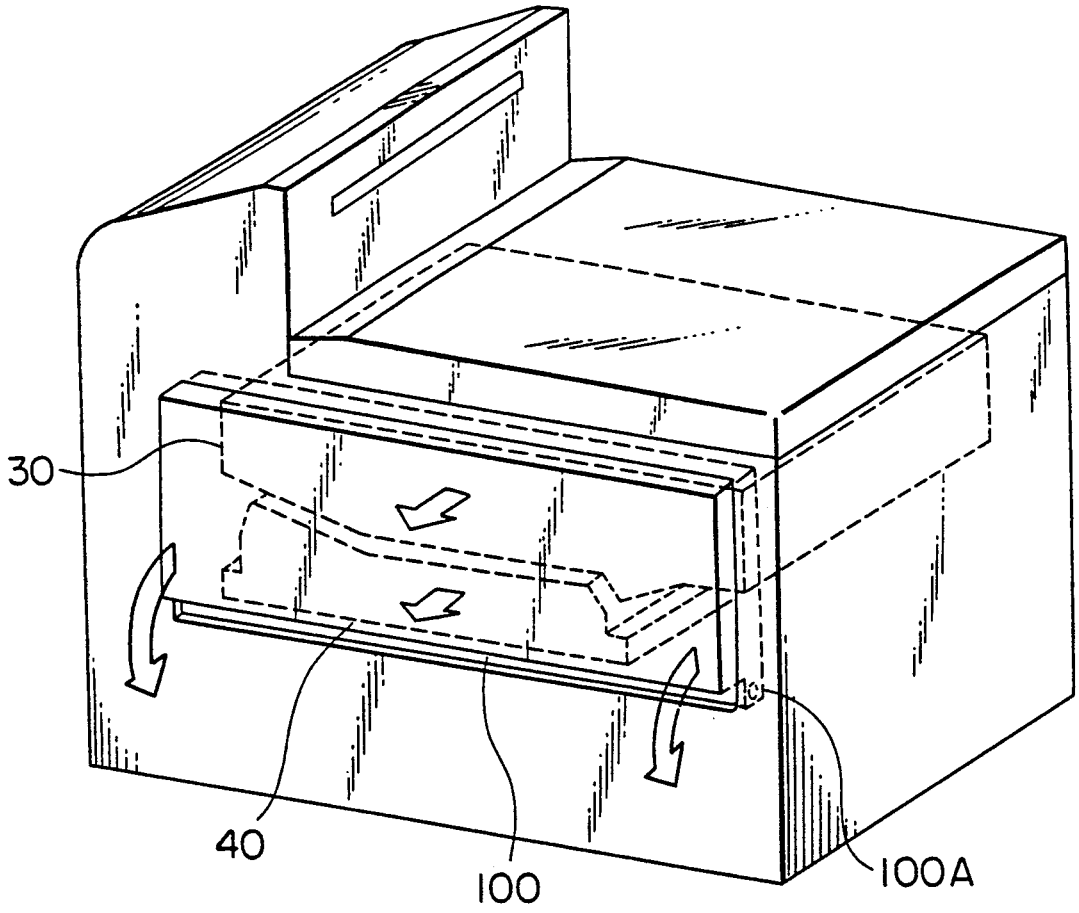
FIG. 17 is a perspective view of a front cover of the apparatus.

The cartridge 30 and the developing unit 40 can be inserted into the main body in a way such that a front cover 100 of the main body shown in FIG. 17 is made to open forward at virtually right angles with a fulcrum of a supporting shaft 100A.

Figure 18:
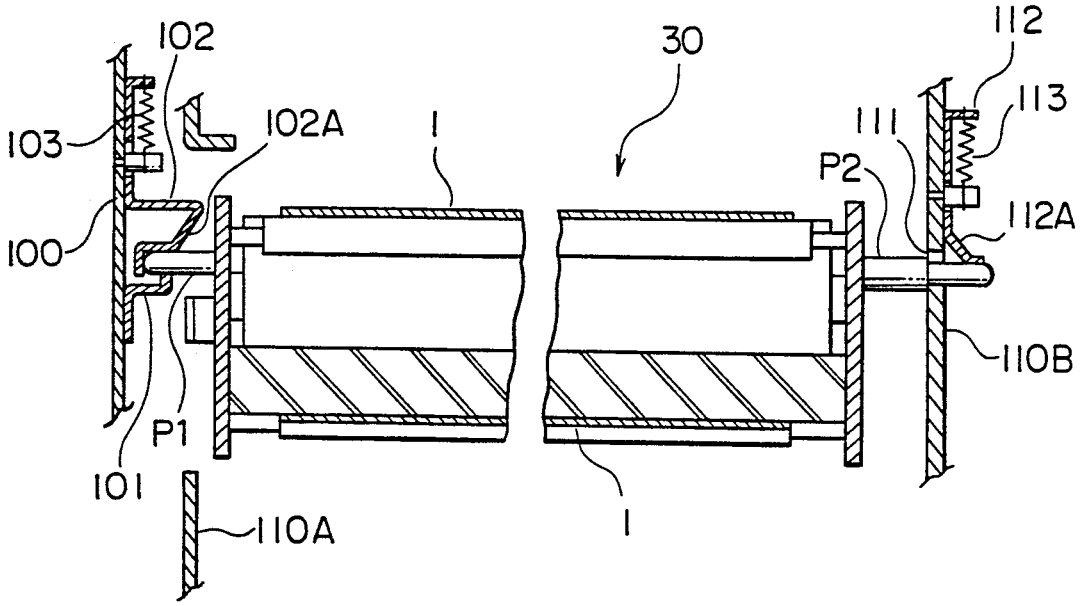
FIGS. 18, 19, 20, and 21 are cross-sectional illustrative views of the cartridge and developing unit.
Figure 19:
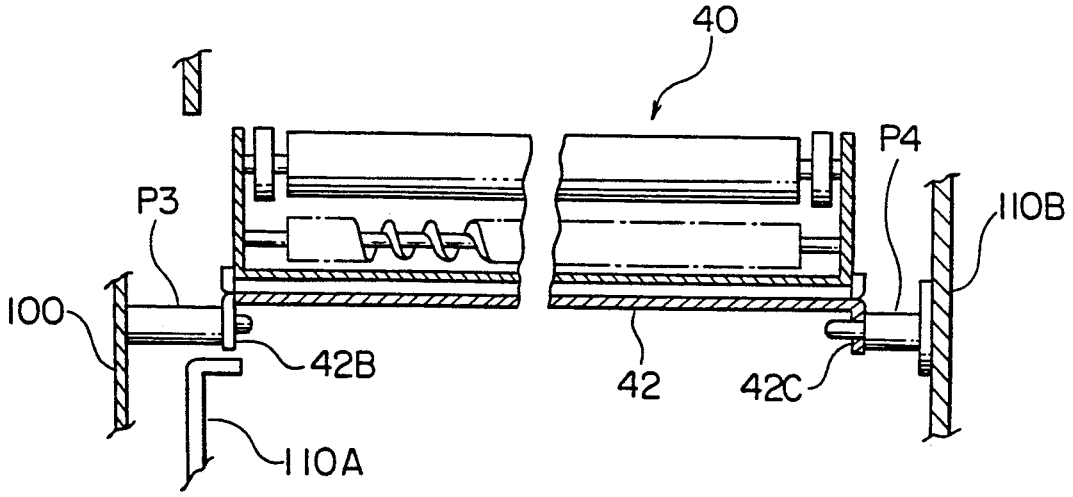

FIGS. 18 and 19 show a cross-sectional view taken across arrows A—A of the cartridge 30 shown in FIG. 15 and a cross-sectional view taken across B—B of the developing unit 40 shown in FIG. 16, respectively.

The cartridge 30 has a pair of the fitting pin P1 and P2 positioned outside the front panel 30A and the rear panel 30B, respectively, each being opposite to the other. In the main body, on the other hand, force exerting means is provided for exerting forces to the cartridge 30 to enter the main body in position by pressing the fitting pin P1 and pin P2.

In FIG. 18, a stop plate 101 is provided to restrict the fitting pin Pl of the cartridge 30 fitted inside the front cover 100 to a lower limit. A pressing bracket 102 which has a slant side 102A can be guided to slide down by an action of a tension spring 103. If the cartridge 30 is not in position, the pressing bracket 102 can be held a little lower than position shown.

On the other hand, the long hole 111 is provided to fit the fitting pin P2 on a rear side plate 110B. A pressing bracket 112 which has a slant side 112A can be guided to slide downward by an action of a tension spring 113. If the cartridge 30 is not in position, the pressing bracket 102 can be held a little lower than the position shown.

The developing unit 40 has fitting holes H both at the front center of bent portion 42B and rear front portion 42C of the supporting base 42. In the main body, on the other hand, are provided a fitting pin P3 and a fitting pin P4 on the front cover 100 and inside of a rear side plate 110B thereof to fit with the fitting holes H.

To attach the cartridge 30, first the fitting pin P2 on the rear side should be inserted into the long hole 111 of the rear side plate 110B. When inserting the fitting pin P2 into the long hole 111, the pressing bracket 112 is to be slided upward to press the slant side 112A. After fitting, the pressing force of the pressing bracket 112 presses the pressing bracket 112 to a lower end of the long hole 111. As a result, a front end of the cartridge 30 can be held a little higher than horizontal as it is subjected to a clockwise moment with a fulcrum of the fitting position with the long hole 111.

Accordingly, in the state where the cartridge 30 can be inclined in position with its front end directed upward, it can be attached to or detached from the main body with without interfering with the developing unit 40 which is mounted under it.

The cartridge 30 can be automatically set in position by closing the front cover 100. This allows the image forming surface of the flexible photosensitive belt 1 to be set with a specific gap from the developing sleeves 8A, 9A, 10A, and 11A. That is, while the front cover 100 is closed, by way of the slant side 102A, pressing bracket 102 can press the fitting pin P1 downward from its position a little higher than horizontal. At the end of closing, as shown, the fitting pin Pl is put between the pressing bracket 102 and the stop plate 101 to be hold.

On the other hand, to mount the developing unit 40, first the fitting hole H of the bent portion 42B should be fitted on the fitting pins P4 of the rear side plate 110B so that the bent portion 42B can be held by a bent portion of the front side plate 110A. The front cover 100 then should be closed to fit the fitting pin P3 into the fitting hole H of the bent portion 42B, and the developing unit 40 should be set in position on the main body.

As a result, the developing unit 40 can be held horizontal and pressed toward the cartridge 30. This allows a thrusting roller (which will be described later) of each developing sleeve against be pressed to the guide member 4 to form of the gap between the developing sleeve and the flexible photosensitive belt 1. When the developing unit 40 is pressed, the thrusting roller of each developing sleeve can be properly pressed to the curved surface of the guide member 4 with a uniform load by means of the flexibility of the developer container 41 itself and the elasticity of the compressing spring 43 acting on the developer container 41.

Figure 20:
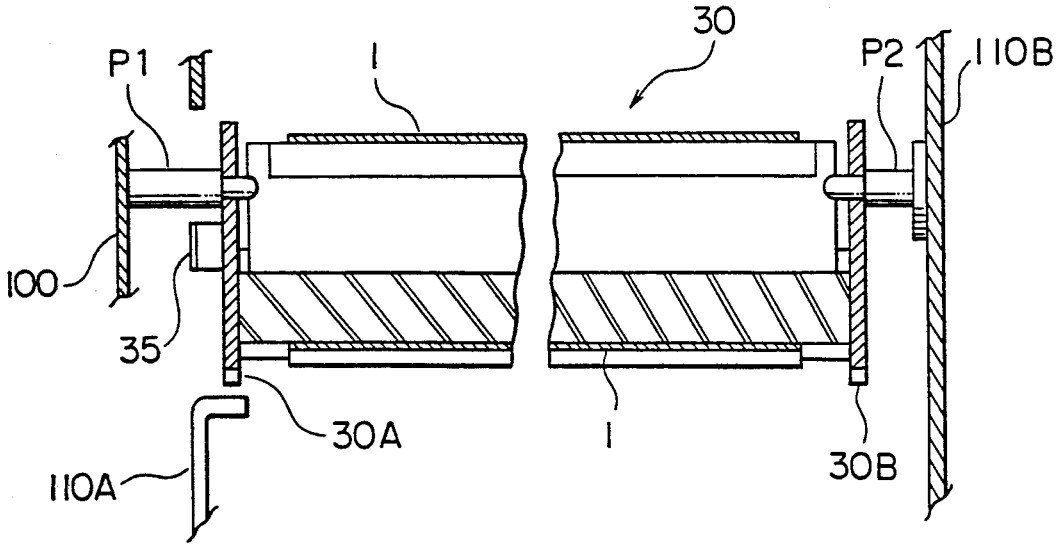
Figure 21:
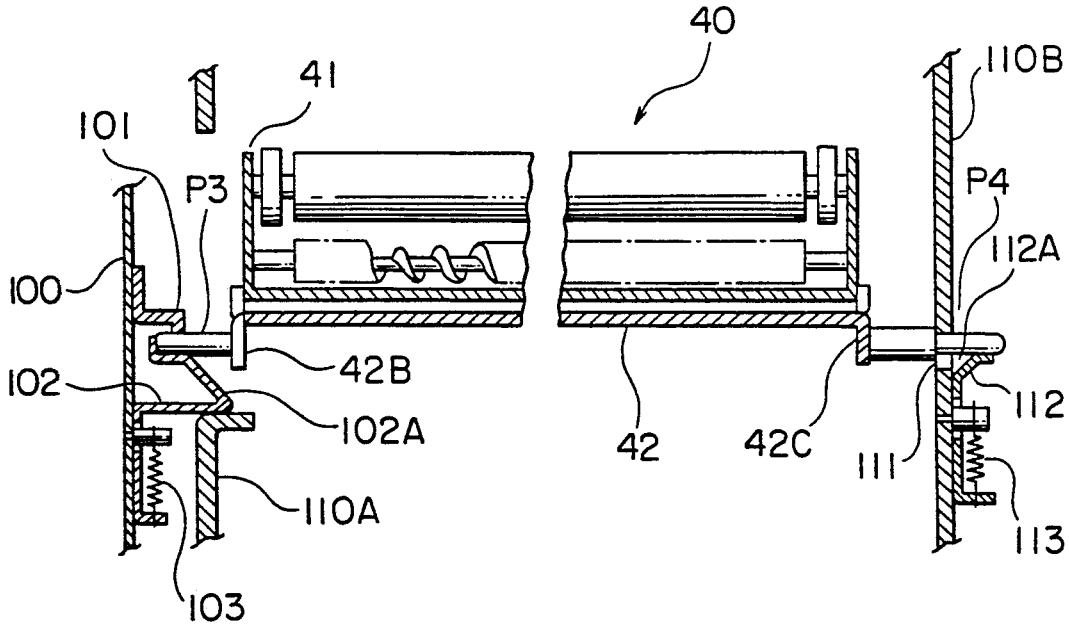

The third embodiment described above can be accomplished in the following construction. FIGS. 20 and 21 like FIGS. 18 and 19 show a cross-sectional view taken across arrows A—A of the cartridge 30 shown in FIG. 15 and a cross-sectional view taken across B—B of the developing unit 40 shown in FIG. 16, respectively.

The cartridge 30 has a pair of the fitting holes H passing through the front panel 30A and the rear panel 30B at positions opposite to each other. The main body, on the other hand, has the fitting pin P1 and the fitting pin P2 to fit with the fitting holes H on the inside of the rear side plate 110B thereof.

To mount the cartridge 30, first, one of the fitting holes H on the side of the rear panel 30B should be fitted on the fitting pin P2 of the rear side plate 110B so that a part of the front panel 30A can be held by a bent portion of the front side plate 110A. The front cover 100 then should be closed to fit the fitting pin P1 in the other one of the fitting holes H on the side of the front panel 30A. The cartridge 30 should be set in position in the main body.

The developing unit 40 has the fitting pin P3 fitted in the bent portion 42B at the front central portion of the supporting base 42, and has the fitting pin P4 in the bent portions 42C on the rear position of the supporting base 42. The main body has a force exerting arrangement to press the fitting pin P3 and P4 to move the developing unit 40 toward the cartridge 30.

In FIG. 21, the stop plate 101 is provided to restrict the fitting pin P3 of the developing unit 40 fitted inside the front cover 100 to an upper limit. A pressing bracket 102 which has a slant side 102A can be guided to slide upward by an action of the tension spring 103. If the developing unit 40 is not in position, the pressing bracket 102 can be held a little higher than the position shown.

On the other hand, the long hole 111 is provided to fit the fitting pin P4 on the rear side plate 110B. The pressing bracket 112 which has the slant side 112A can be guided to slide upward by an action of the tension spring 113. If the developing unit 40 is not in position, the pressing bracket 102 can be held a little higher than the position shown.

To mount the developing unit 40, first, the fitting pin P4 at the rear side should be fitted on the long hole 111 of the rear side plate 110B, and then the pawls 42B at the front central portion should be put on an upper edge of the front side plate 110A. In fitting the fitting pin P4 in the long hole 111, the slant side 112A is pressed to slide the pressing bracket 112 downward. After fitting, a pressing force of the pressing bracket 112 presses the fitting pin P4 to an upper edge of the long hole 111.

Accordingly, in the state where the developing unit 40 can be inclined in position with its front end lowered the developing sleeves 8A, 9A, 10A, and 11A of respective developing means can be separated from the flexible photosensitive belt 1 incorporated in the cartridge 30. As a result, the cartridge 30 can be attached to or detached from the main body interfering with to the developing unit 40 which is mounted under it.

The developing unit 40 can be automatically set in position by closing the front cover 100, as was the case with the cartridge 30. This allows the developing sleeves to be set with a developing gap between the flexible photosensitive belt 1. That is, while the front cover 100 is closed, the slant side 102A pressing bracket 102 can press upward the fitting pin P3 of the developing unit 40 held by the front side plate 110A. At the end of closing, as shown, the fitting pin P3 is put between the pressing bracket 102 and the stop plate 101 to held.

As a result, the developing unit 40 can be held horizontal and pressed toward the cartridge 30. This allows a thrusting roller (which will be described later) of each developing sleeve to be pressed against the guide member 4 to form a gap between the developing sleeve and the flexible photosensitive belt 1. When the developing unit 40 is pressed, the thrusting roller of each developing sleeve can be properly pressed against the curved surface of the guide member 4 with a uniform load by means of the flexibility of the developer container 41 itself and the elasticity of the compressing spring 43 acting on the developer container 41.

Figure 22:
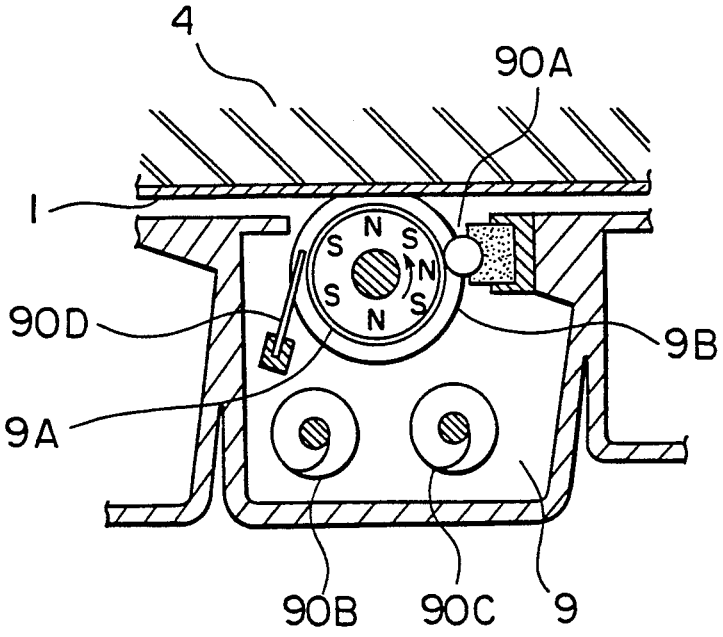
FIG. 22 is a cross-sectional illustrative view of a developing means.

The following paragraphs describe the construction and features of the developing means 9, as an example. FIG. 22 shows a cross-sectional view of the developing means 9. A developing sleeve 9A which has a magnet roller fixed thereinside can be revolved counterclockwise to keep a developing gap between the outside of the flexible photosensitive belt 1. A developer layer forming member 90A which has a magnetic, rigid property can be pressed against the developing sleeve 9A with a certain load when there is not any developing agent on it. A pair of toner carrying screws 90B and 90C can carry the developing agent to circulate in direction opposite to each other. They can fully stir and mix the toner and carrier, and feed them as the developing agent to the developing sleeve 9A.

The toner and carrier fed into the inner part by the toner carrying screw 90B is moved to the side of the toner carrying screw 90C. They then are fed to the front side as shown in the drawing. In this process, the toner and carrier can form charged by friction of the mixing action to be a uniform developing agent. The developing agent is adhered in a layer onto the outside of the developing sleeve 9A.

The developing agent layer on the developing sleeve 9A can develop the latent image as a reversal toner image on the outside of the flexible photosensitive belt 1 carried clockwise in the developing area. This is achieved in noncontact way by means of the developing gap.

In the noncontact development process, the developing sleeve 9A has a developing bias containing an alternating current component in addition to a direct current component applied from a power supply (not shown). As a result, only the toner of the developing agent can be selectively moved to the latent image surface to stick thereon.

The developing agent from which the toner component was consumed is increased in its ratio of the carrier component. It can be carried by the developing sleeve 9A and peeled off by the scraper 90D to be collected. It then is mixed with the developing agent again which has a higher ratio of toner.

The main body has the paper feed guide 15, a pair of timing rollers 17, a pair of fixing rollers 18, and a transfer unit 12 held on a side cover 200 which can be opened or closed, forming the left-hand section of the main body.

Figure 23:
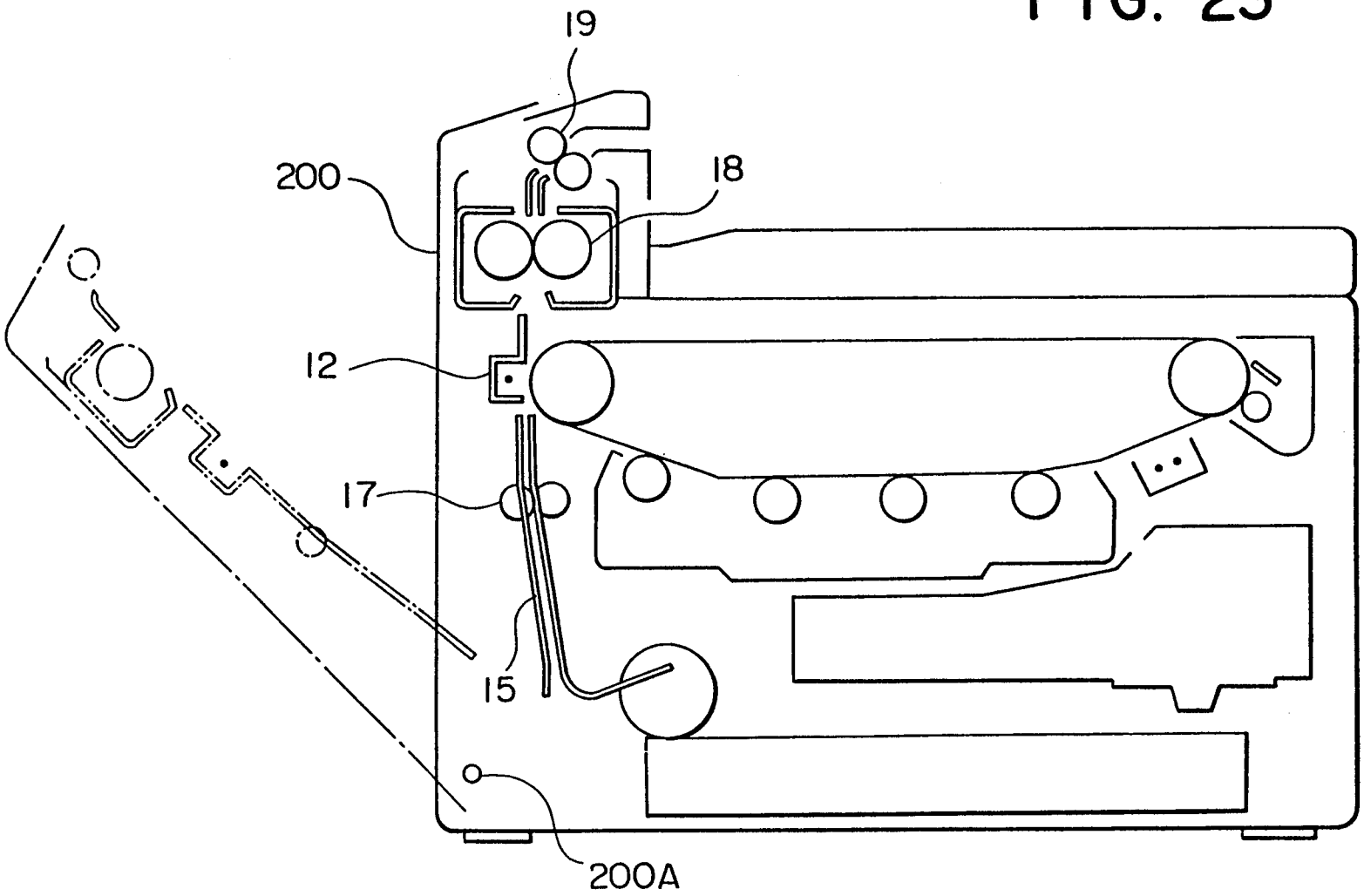
FIG. 23 is a cross-sectional illustrative view of a side cover of the apparatus.

If jamming of the transference material occurs, the side cover 200 can be opened to allow easy action such as removal of the transfer material as shown by a dot-dash line in FIG. 23.

A supporting shaft 200A may be provided on a top portion of the main body so that the side cover 200 can be opened upward.

The color image forming apparatus according to the present invention makes a free attachment or detachment of a process cartridge and developing means to the main body in a way such that the process cartridge containing the belt-like image forming body can be separated from the group of developing means with a very simple mechanism and easy handling without interference of the cartridge with the developing unit containing the group of developing means. As a result, maintenance and service can be readily and fully made for the image forming means. This assures a quality image reproduction at all times.

While the principles of the invention have been described above in connection with specific embodiments and particular modifications thereof, it is to be clearly understood that this description is made only by way of example and does not limit on the scope of the invention.

What is claimed is:

1. A color image forming apparatus, comprising:

a photoreceptor belt for forming a latent image thereon, the photoreceptor belt being stretched to form a loop around a plurality of rotatable rollers;

a plurality of developing means for developing the latent image on the photoreceptor belt to form a toner image;

cleaning means for removing residual toner from the photoreceptor belt;

a container, disposed inside the loop of the photoreceptor belt, for collecting residual toner therein;

transporting means for transporting residual toner from the cleaning means to the container; and a cartridge comprising the photoreceptor belt, the cleaning means, the container and the transporting means in one unit;

wherein the cartridge is adapted to be installable into and detachable from the color image forming apparatus.

2. The apparatus of claim 1, wherein said container is an airtight box.

3. The apparatus of claim 1, further comprising guide means disposed inside the loop of the photoreceptor belt, for guiding the photoreceptor belt, wherein the container is formed on a part of the guide means.

4. The apparatus of claim 1, wherein the cartridge is provided with a handle on one side thereof, and wherein the container comprises an inlet for collecting residual toner on the side of the cartridge on which the handle is provided.

5. The apparatus of claim 1, wherein the apparatus includes an upper portion and a lower portion which are coupled together by a hinge so that the upper portion is movable to a slanted open position by being pivoted around the hinge, and wherein the cartridge is installed in the upper portion and wherein the container has an inlet for collecting residual toner at an upper position when the upper portion is moved to the slanted open position.

6. The apparatus of claim 1, wherein the container comprises distribution means for evenly distributing residual toner in the container.

7. The apparatus of claim 6, wherein the distribution means comprises a belt-like carrier provided inside the container.

8. The apparatus of claim 6, wherein the distribution means comprises means for exerting an impact force to the container.

9. The apparatus of claim 1, wherein the developing means is movable and detachable from the apparatus, and wherein a supply part of the developing means is covered when the developing means is moved or dismounted from the apparatus.

10. A color image forming apparatus, comprising:

a photoreceptor belt for forming a latent image thereon, the photoreceptor belt for forming a latent image thereon, the photoreceptor belt being stretched to form a loop around a plurality of rotatable rollers;

a cartridge, adapted to be installable into and detachable from the apparatus, for housing the photoreceptor belt;

a plurality of developing means for developing the latent image on the photoreceptor belt so as to form a color toner image, the plurality of developing means being disposed to face the photoreceptor belt when the cartridge is installed in the apparatus; and a toner supply unit including a plurality of toner containers for supplying toner to the plurality of developing means, the toner supply unit being detachably mounted on the cartridge.

11. The apparatus of claim 10, wherein the toner supply unit is arranged to be mounted on the cartridge when the cartridge has been installed in the apparatus.

12. The apparatus of claim 10, wherein the developing means is movable and detachable from the apparatus; and wherein a supply part of the developing means is covered when the developing means is moved or detached from the apparatus.

13. A color image forming apparatus, comprising:

a photoreceptor belt for forming a latent image thereon, the photoreceptor belt being stretched to form a loop around a plurality of rotatable rollers;

a cartridge, adapted to be installable into and detachable from the apparatus, for housing the photoreceptor belt;

a plurality of developing means for developing the latent image on the photoreceptor belt so as to form a color toner image, the plurality of developing means being disposed to face the photoreceptor belt when the cartridge is installed in the apparatus; and means for moving the cartridge, the moving means including means for moving the cartridge vertically and means for moving the cartridge horizontally.

14. The apparatus of claim 13, wherein the plurality of developing means are arranged to be detached from the apparatus after the cartridge is moved or detached from the apparatus.

15. The apparatus of claim 13, wherein the developing means is movable and detachable from the apparatus, and wherein the cartridge is arranged to be detached after the plurality of developing means is moved or detached from the apparatus.

16. The apparatus of claim 13, wherein the developing means is movable and detachable from the apparatus; and wherein a supply part of the developing means is covered when the developing means is moved or detached from the apparatus.

17. A color image forming apparatus, comprising:

a photoreceptor belt for forming a latent image thereon, the photoreceptor belt being stretched to form a loop plurality of rotatable rollers;

a cartridge, adapted to be installable into and detachable from the apparatus, for housing the photoreceptor belt;

a plurality of developing means for developing the latent image on the photoreceptor belt so as to form a color toner image, the plurality of developing means being disposed to face the photoreceptor belt when the cartridge is installed in the apparatus; and means for moving the plurality of developing means, the moving means including means for moving the plurality of developing means vertically and means for moving the plurality of developing means horizontally.

18. The apparatus of claim 14, wherein the plurality of developing means is detachable from the apparatus, and wherein the cartridge is arranged to be detached from the apparatus after the plurality of developing means is moved or detached from the apparatus.

19. The apparatus of claim 17, wherein the cartridge is movable, and wherein the plurality of developing means are arranged to be detached from the apparatus after the cartridge is moved or detached from the apparatus.

20. The apparatus of claim 17, wherein the developing means is detachable from the apparatus; and wherein a supply part of the developing means is covered when the developing means is moved or detached from the apparatus.

21. A color image forming apparatus, comprising:

a photoreceptor belt for forming a latent image thereon, the photoreceptor belt being stretched to form a loop around a plurality of rotatable rollers;

a plurality of developing means for developing the latent image on the photoreceptor belt so as to form a color toner image, the plurality of developing means being disposed to fae the photoreceptor belt when the cartridge is installed in the apparatus;

a toner supply unit including a plurality of toner containers for supplying toner to the plurality of developing means; and a cartridge, adapted to be installable into and detachable from the apparatus, for housing the photoreceptor belt and the toner supply unit, the toner supply unit being adapted to be detachable from the cartridge when the cartridge is detached from the apparatus.

* * * * *